US006666719B1

(12) United States Patent
Kuroi et al.

(10) Patent No.: US 6,666,719 B1
(45) Date of Patent: Dec. 23, 2003

(54) CONNECTORS WITH SHROUD HAVING INTERNAL GROUNDED SHIELD

(75) Inventors: Yoshihiro Kuroi, Tokyo (JP); Wataru Takahashi, Tokyo (JP); Kazuya Kikuchi, Tokyo (JP)

(73) Assignee: NEC Tokin Corporation, Miyagi (JP)

( * ) Notice: Subject to any disclaimer, the term of this patent is extended or adjusted under 35 U.S.C. 154(b) by 29 days.

(21) Appl. No.: 09/607,425

(22) Filed: Jun. 29, 2000

(30) Foreign Application Priority Data

Jun. 29, 1999 (JP) ..... 11-184284

(51) Int. Cl.[7] ..... H01R 13/648

(52) U.S. Cl. ..... 439/607; 439/358; 439/939; 439/603

(58) Field of Search ..... 439/607, 609, 439/610, 358, 939, 608, 603

(56) References Cited

U.S. PATENT DOCUMENTS

| | | | | | |
|---|---|---|---|---|---|
| 3,523,269 | A | * | 8/1970 | Witek, Jr. et al. | |
| 4,571,012 | A | * | 2/1986 | Bassler et al. | 439/607 |
| 4,601,527 | A | | 7/1986 | Lemke | |
| 4,603,936 | A | * | 8/1986 | Jagen | |
| 4,738,637 | A | * | 4/1988 | Asick et al. | |
| 4,773,878 | A | * | 9/1988 | Hansell, III | 439/610 |
| 4,878,858 | A | * | 11/1989 | Dechelette | |
| 4,993,971 | A | * | 2/1991 | Matsuzaki et al. | 439/607 |
| 5,007,862 | A | * | 4/1991 | Defibaugh et al. | 439/607 |
| 5,041,022 | A | * | 8/1991 | Sekiguchi | 439/609 |
| 5,295,867 | A | * | 3/1994 | Bethurum | 439/607 |
| 5,312,273 | A | * | 5/1994 | Andre et al. | 439/607 |
| 5,417,590 | A | * | 5/1995 | Dechelette et al. | 439/607 |
| 5,637,014 | A | * | 6/1997 | Sukegawa et al. | 439/607 |
| 5,913,690 | A | * | 6/1999 | Dechelette et al. | 439/607 |
| 5,997,361 | A | * | 12/1999 | Driscoll et al. | 439/358 |
| 6,215,666 | B1 | * | 4/2001 | Hileman et al. | 351/752 |

FOREIGN PATENT DOCUMENTS

| | | |
|---|---|---|
| DE | 19732284 | 2/1999 |
| EP | 0836249 | 4/1998 |
| JP | 2-148584 | 6/1990 |
| JP | 6-124739 | 5/1994 |
| JP | 7-162183 | 6/1995 |
| JP | 7-312262 | 11/1995 |
| JP | 7-320816 | 12/1995 |
| JP | 7-320817 | 12/1995 |
| JP | 9-148008 | 6/1997 |

* cited by examiner

*Primary Examiner*—Neil Abrams
(74) *Attorney, Agent, or Firm*—Dickstein, Shapriro, Morin & Oshinsky, LLP.

(57) ABSTRACT

A cable connector has a shroud including an elongated recess and provided with an internal grounded shield which extends within and substantially along the entire length of the elongated recess. The cable connector further has a cable receptacle including an elongated housing for cable conductors and a housing shield surrounding the housing. The housing and shroud shield are juxtaposed with one another along the entire length of the recessed inner surface of the shroud to form a double shield cover protecting the cable connectors within the shroud when of the cable receptacle is attached to the shroud. The shroud shield may be formed as separate plates located on each inner shroud wall and may include springs for engaging a metal panel. The shroud bottom wall may include compressible tubular parts which form openings in the shield bottom wall to secure contacts.

17 Claims, 21 Drawing Sheets

CONNECTORS WITH SHROUD HAVING INTERNAL GROUNDED SHIELD

BACKGROUND OF THE INVENTION

1. Field of the Invention

This invention relates to structures for connecting and grounding a shielded connector and a receiving connector, and more particular to structures in which a shielding layer of a cable can be reliably grounded.

This application is based on Patent Application No. Hei11-184284 filed in Japan, the contents of which are incorporated herein by reference.

2. Background Art

In recent years, with higher speed and higher frequency of transmission signals in electronic devices, it has become more necessary to take measures to fully protect connectors used in the electronic devices from electromagnetic interference (referred to as EMI hereinafter). Especially for cable connectors used for connecting a shielded cable and a circuit board, the structure of the shielding part of the cable connector and the attachment structure of the cable connector around the shielding part are important in these measures because undesired electromagnetic radiation can be suppressed if the shielding layer of the shielded cable can be grounded with low impedance through the shielding part of the cable connector.

In one example, shown in FIGS. 20 and 21, a connector 1 is provided with cables 4 which are covered with a shielding shell 3, in a cover 2. A panel connector 5 is U-shaped in cross-sectional view, and is provided on the other side of a conductive panel 6. Contact pins 7 project inside the panel connector 5.

As the connector 1 is inserted to the panel connector 5, the contact pins 7 become inserted to contacts 8 of the connector 1 and the cables 4 become connected to a circuit and so on (not shown). Spring parts 9 are formed extending over a front edge of the cover 2 in the shielding shell 3. The spring parts 9 are kept in contact with the conductive panel 6 when the connector 1 is inserted into the panel connector 5, so that the shielding shell 3 can be grounded to the conductive panel 6 under enough contact pressure to achieve grounding applied by the spring parts. A locking device 10 which can engage the panel connector 5 is provided on one side of the cover 2. This structure is described in Japanese Unexamined Patent Application Hei 7-320816.

However, the prior art described above has a disadvantage that it is easy for the spring part 9 to suffer damage and deformation as a result of hitting other members when the connector 1 is inserted, because the spring part 9 is provided at the front edge of the connector 1 along the direction of insertion. Additionally, it takes a long time to attach the spring part 9, especially because, when the connector 1 is inserted, the attachment must be performed carefully so as not to deform the spring part 9 through contact with the surroundings of the opening formed in the conductive panel 6.

Additionally, the prior art also has another disadvantage that it is difficult to ensure the appropriate value of the contact pressure to achieve grounding, because, in a side of the connector 1 in which the locking device 10 is provided, there is a part in which the spring part 9 cannot be positioned because of space requirements for the locking device 10 and the locking device 10 cannot be provided on both sides, for example, because of miniaturization of the connector 1.

In consideration of the above circumstances, the present invention provides structures for connecting a shielded connector and a receiving connector and grounding them, in which a cable can be reliably attached without damage and deformation of the spring parts or spring members, even when the connectors are packaged with high density.

SUMMARY OF THE INVENTION

In order to resolve the above-described problem, a structure for connecting a shielded connector and a receiving connector comprises a connector provided with a housing which holds a cable; and a receiving connector attached to a circuit board, which receives the housing so that the cable is electrically connected to the circuit board; wherein the receiving connector has a shroud and a male contact within the shroud, a shielding member connected electrically to a shielding layer of the cable is provided on the outer wall of said housing, a shielding member is provided on the inner wall of the shroud, the surroundings of the cable can be shielded by both of the shielding members when the connector is inserted into the shroud, and contact springs are provided in the shroud to bring about elastic contact between one shielding member and the other shielding member so that both shielding members are electrically connected to each other, and grounding parts for grounding the circuit board which is electrically connected to the shielding member provided in the shroud are formed in the shielding member provided in the shroud.

As a result of the arrangement described above, the shielding member in the shielded connector can make reliable electrical connection with the shielding member in the receiving connector within the shroud by means of contact springs, and the shielding layer surrounding the cable can be reliably grounded to the circuit board through the grounding parts in the shielding member in the receiving connector.

A structure for connecting a shielded connector and a receiving connector comprises a connector provided with a housing which holds a cable; and a receiving connector attached to a circuit board, which receives the housing so that the cable is electrically connected to the circuit board; wherein the receiving connector has a shroud and a male contact within the shroud, a conductive panel which is fixed at the opening edge of the shroud and through the opening of which the connector passes, is provided between the connector and the shroud, a shielding member connected electrically to a shielding layer of the cable is provided on the outer wall of the housing, a shielding member is provided on the inner wall of the shroud, the surroundings of the cable can be shielded by both of the shielding members when the connector is inserted into the shroud, and contact springs are provided in the shroud so as to bring about elastic contact between on shielding member and the other shielding member so that both shielding members are electrically connected to each other, and grounding springs are formed in an extending part of an edge of the shielding member provided in the shroud so that the grounding springs make elastic contact with the rear side of the conductive panel.

As a result of the arrangement described above, when the shielded connector is inserted into the shroud in the receiving connector, the shielding member in the connector can make reliable electrical connection with the shielding member in the receiving connector by means of contact springs and the shielding layer surrounding the cable can be reliably grounded to the conductive panel due to the elastic contact between the grounding springs of the shielding layer in the receiving connector and the conductive panels.

According to another aspect of the present invention a structure for connecting a shielding connector and a receiving connector is provided on the outer wall of the housing with a shell-shape, the shielding member provided on the inner wall of the shroud has a case-shape, the contact springs are provided on the outer wall of the shielding member which has a shell-shape and which covers the housing of the connector, and the contact springs can be in contact with the shield member which has a case-shape and which is provided on the inner wall of the shroud when said connector is inserted into the shroud.

As a result of the arrangement described above, both shielding members can make reliable electrical connection with each other by means of contact springs provided in the shielded connector and the shielding layer surrounding the cable can be reliably grounded to the circuit board through the grounding parts formed in the shielding member in the receiving connector.

In accordance with a further aspect, the present invention has a structure, wherein the shielding member provided on the outer wall of the housing has a shell-shape, the shielding member provided on the inner wall of the shroud has a case-shape, and the contact springs are provided on the shield member which has a case-shape and which is provided on the inner wall of the shroud, the contact springs can be in contact with the outer wall of the shielding member which has a shell-shape and which covers the housing when the connector is inserted into the shroud.

As a result of the arrangement described above, both shielding members can make reliable electrical connection with each other by means of contact springs provided in the shielded connector and the shielding layer surrounding the cable can be reliably grounded to the circuit board through the grounding parts formed in the shielding member in the receiving connector.

Furthermore, an inventive structure has the grounding parts which are formed from extensions of the shielding member provided on the circuit board side of the shroud.

As a result of the arrangement described above, the extensions can be grounded to the circuit board whenever the shroud is installed in the circuit board.

In accordance with another feature of the present invention a shielding member is provided in the shroud as a plate-typed shielding plate, and the shielding plate and the shielding member provided in the connector are arranged to be electrically connected to each other by means of the contact springs which are provided either on the shielding plate or on the shielding member provided in the connector.

As a result of the arrangement described above, the shielding member can be simplified.

Still another feature of the present invention is a structure, wherein the grounding springs which are in contact elastically with the conductive panel are provided on at least one side of the opening edge of the shroud.

As a result of the arrangement described above, grounding can be achieved by means of the minimum number of grounding springs.

The present invention further has a structure, wherein the locking member is provided between the connector and the shroud of the receiving connector and fixes the connector and the shroud of the receiving connector when the connector is inserted into the shroud.

As a result of the arrangement described above, reliable connection between the shielded connector and the receiving connector can be achieved.

According to yet another feature of the present invention, a structure for connecting a shielded connector and a receiving connector has a shielding member provided in the shroud is provided with both said grounding parts and said grounding spring.

As a result of the arrangement described above, the shielding member can be grounded both with the conductive panels and the circuit board.

In the structure for grounding a shield connector and a receiving connector, in accordance with the invention, a connector provided with a housing which holds a cable is inserted into a shroud of the receiving connector attached to a circuit board, which receives the housing so that the cable is electrically connected to the circuit board; wherein a shield layer of the cable is grounded to conductive panels which are fixed tat an opening of the circuit board or the shroud, through the shielding member provided in the housing and the shielding member provided in the shroud.

As a result of the arrangement described above, the shielding layer surrounding the cable can make reliable electrical contact with the circuit board or the conductive panel through the shielded connector and the receiving connector.

BRIEF DESCRIPTION OF THE DRAWINGS

FIG. 2A is a cross section along the line A—A in FIG. 2B, and FIG. 2B is a side view thereof.

FIG. 12B is a plane view thereof.

DETAILED DESCRIPTION OF THE PREFERRED EMBODIMENTS

Hereinafter, several embodiments of the present invention are described in reference to the drawings appended.

Figure 1:
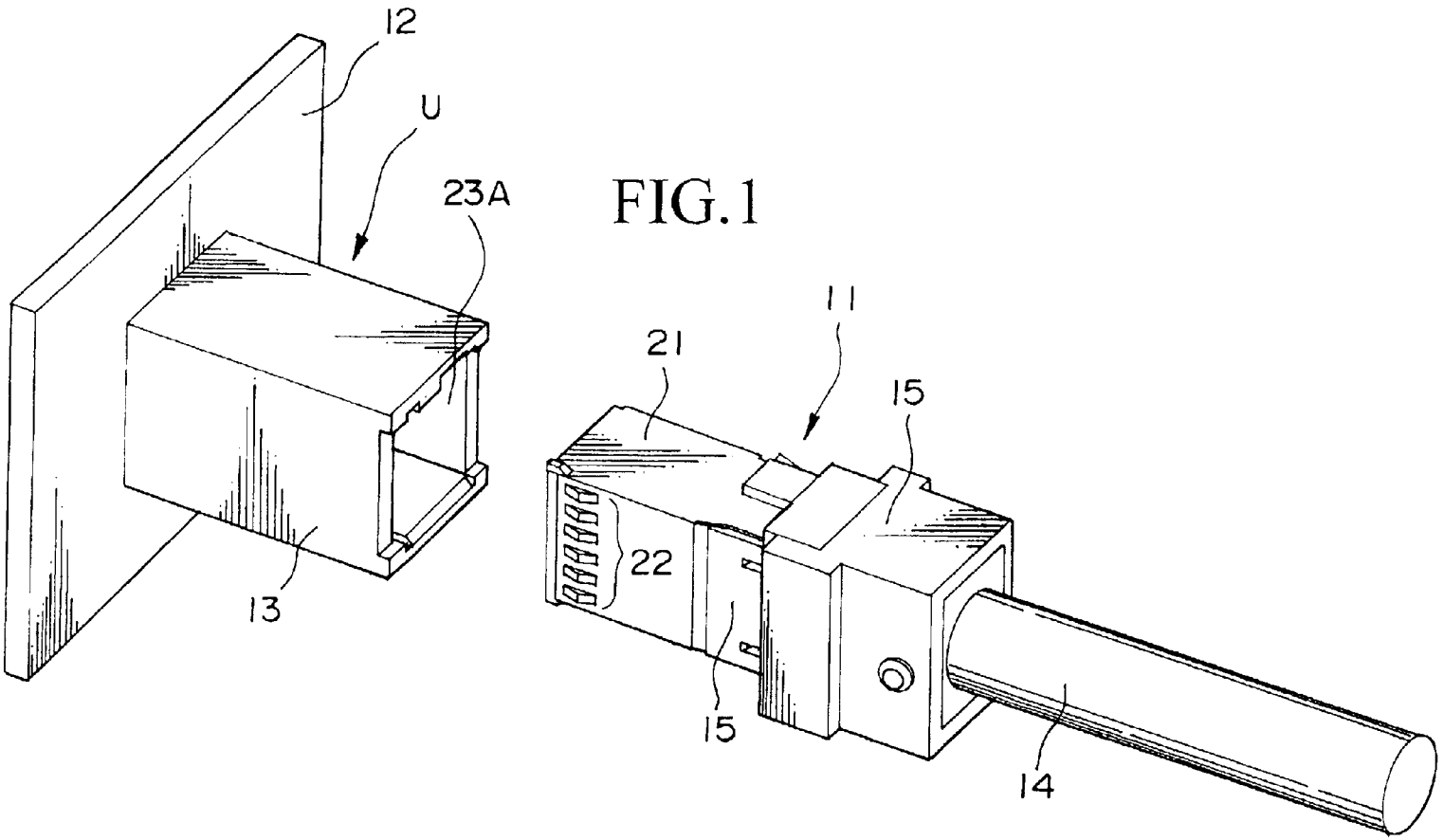
FIG. 1 is a perspective diagram showing a first embodiment of the present invention.
Figure 2A:
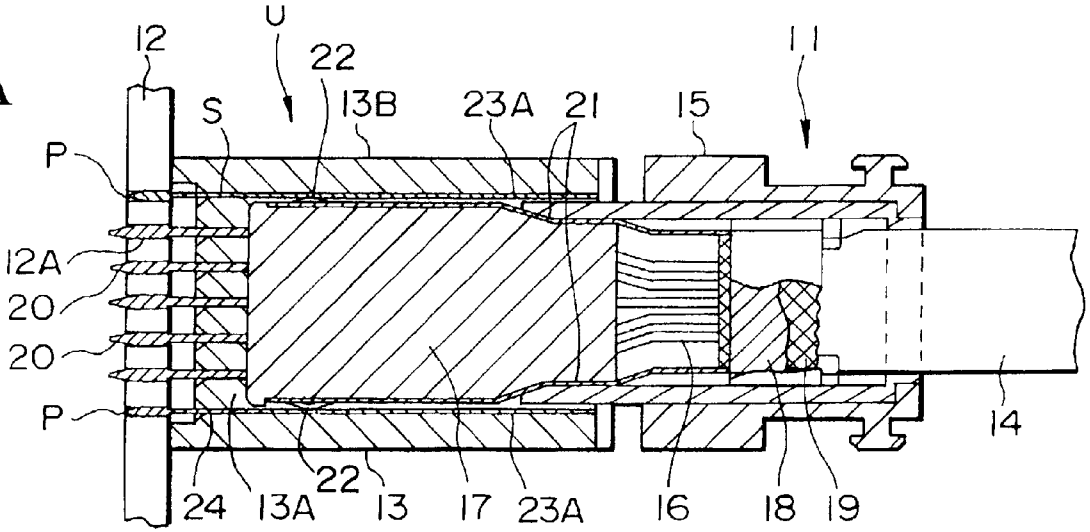
FIGS. 2A and 2B showing the first embodiment of the present invention in an attached state.
Figure 2B:
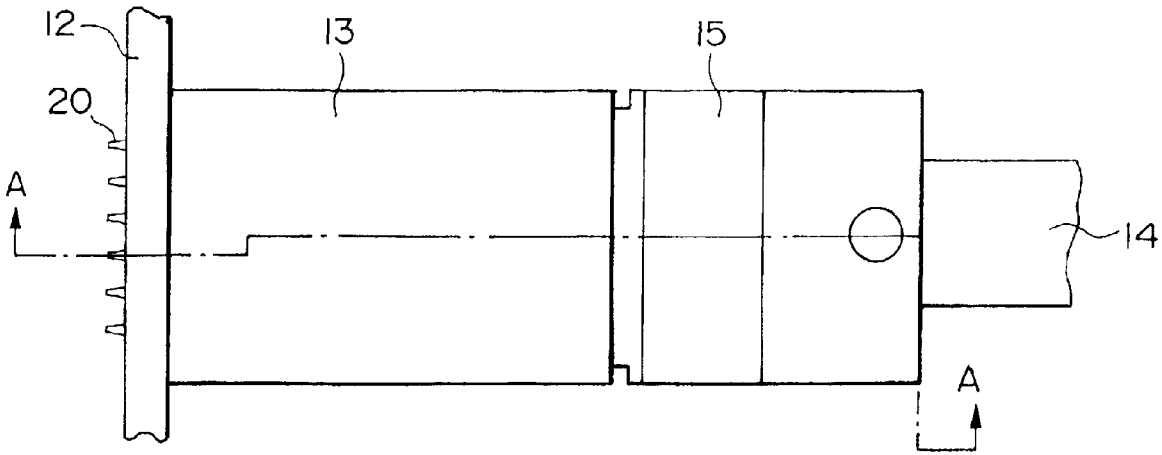
Figure 3:
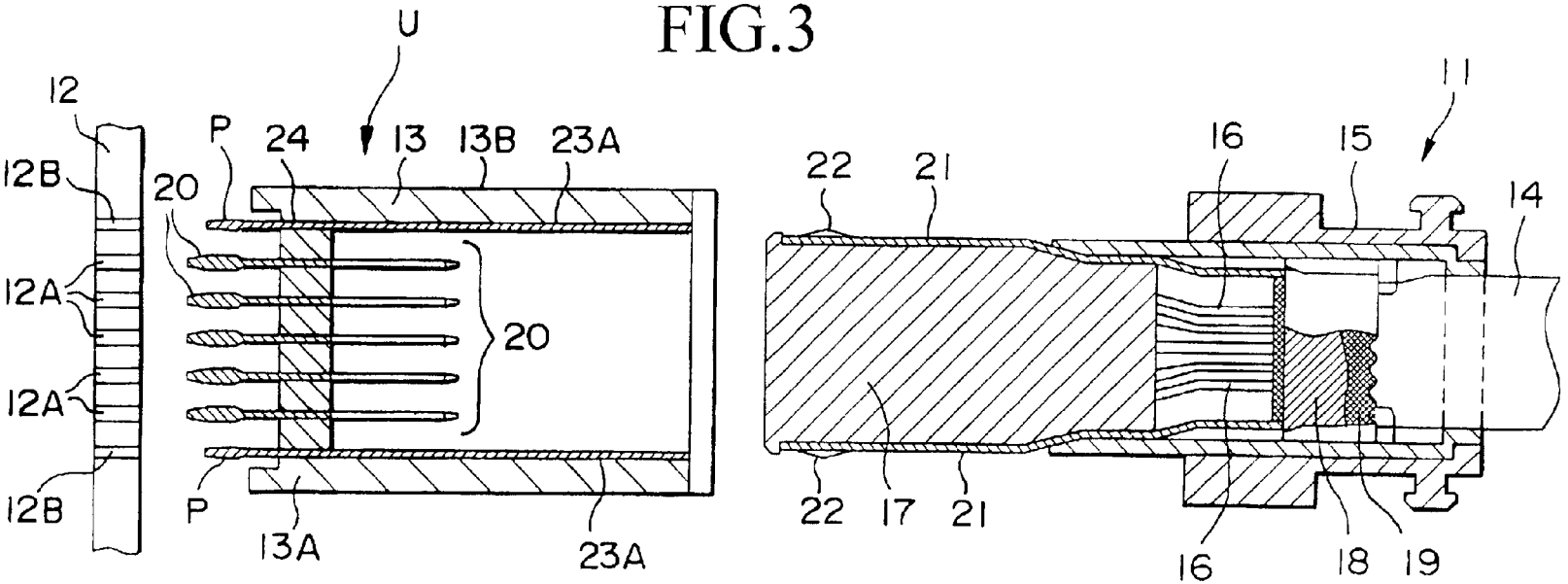
FIG. 3 is an exploded cross section of the first embodiment of the present invention.
Figure 4:
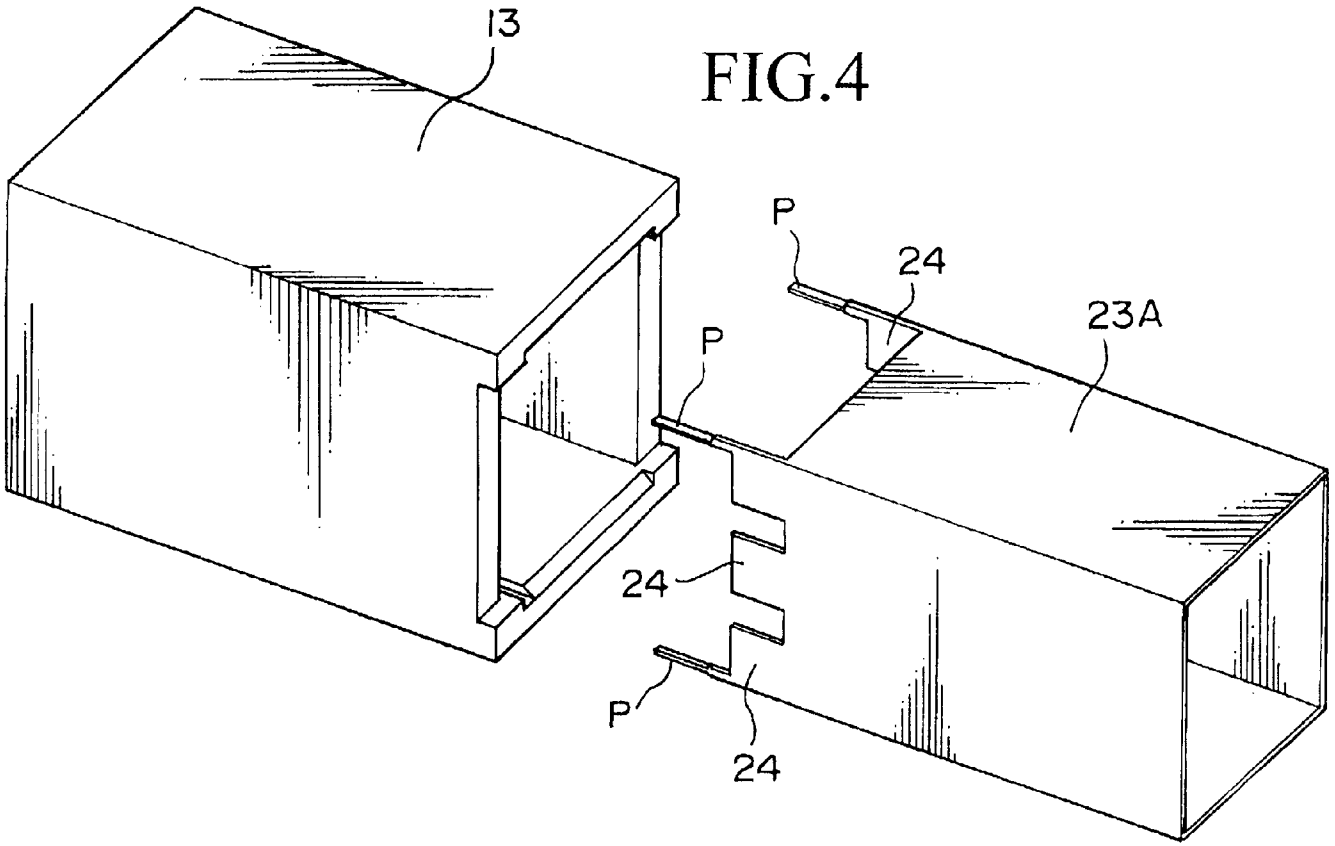
FIG. 4 is a perspective diagram of the main part showing the first embodiment of the present invention.

FIGS. 1 and 4 show a first embodiment of this invention, which is applied to a structure for connecting a shielded connector and a receiving connector used, for example, in a telephone exchange. As shown in FIG. 1, a connector 11 is inserted into a shroud 13 of a receiving connector U which is attached to a circuit board 12. As shown in FIGS. 2 and 3, in the connector 11, a cable 14 is held by a cover 15 and a housing 17 to hold wires 16 is provided at the front end of the cover 15. The wires 16 inside the cable are shielded by a shielding layer 19. The reference numeral 18 shows a shield jacket.

The housing 17 comprises contacts (not shown), which receive male contacts 20 which project into a shroud 13 of the receiving connector U to be electrically connected between the cable 14 and the circuit board 12. The housing 17 is formed with a rectangular shape in cross section, the whole outer wall of which is shielded by a shielding member 21 arranged so as to be in contact with the shield jacket 18 of the cable 14. Here, the shield jacket may also partially cover the outer wall.

A plurality of contact springs (elastic contact members) 22 are provided on one surface and on the other opposing surface of the shielding shell 21 near the front edge of the shielding shell 21 of the housing 17, for example, by cut and raised processing. The contact springs 22 can make elastic contact with and be connected electrically to a shielding case 23A (shielding member) of the shroud 13, when the connector 11 is inserted into the shroud 13. Here, the shielding case 23A is not limited to being cylinder-shaped and can be U-shaped or L-shaped in cross section.

The shroud 13 is box-shaped, and a plurality of male contacts 20 are provided in the bottom wall 13A of the shroud 13. One side of each male contact 20 projects inside the housing 17 and the other side is inserted into a through hole 12A of the circuit board 12.

A shielding case 23A is installed in the shroud. The shielding case 23A is pipe-shaped with a rectangular cross section, as shown in FIG. 4, which is removably inserted into the shroud 13 to cover the inner wall of the shroud 13. Engaging parts 24 are formed extending from each of a pair of the side walls at the ends near the circuit board 12 of the shielding case 23A. These engaging parts 24 are inserted into slits S formed in the bottom wall 13 A of the shroud 13.

Pins (grounding parts, extending parts) P are provided in the engaging parts 24, through holes 12B connected electrically to a grounded layer (not shown) are formed in the circuit board 12 corresponding to those pins. The pins P are pushed into the through holes 12B. Here, on insertion, using connection by means of pressing in or soldering, or soldering to the surface of the circuit board 12, or combinations thereof are possible. Four pins in all are formed in this embodiment, but any number of pins can be formed. Pins P can be formed from extensions of the engaging parts 24.

According to the embodiment described above, the shielding shell 21 of the connector 11 is electrically connected to the shielding case 23A in the shroud 13 and the cable 14 can be reliably grounded to the circuit board 12 through the pins P formed in the shielding case 23A, so that a conductive panel is unnecessary and the shielding layer 19 of the cable 14 can be reliably grounded at low impedance even in parts in which a conductive panel and attachments are not provided. Electromagnetic waves going to the wires 16 from outside or electromagnetic waves coming out of wires 16 can be reliably shielded by the shielding shell 21 and the shielding case 23A.

Because contact springs 22 are provided in the shielding shell 21 in the housing in the connector 11, the springs 22 do not make contact with the end of the shroud 13 when the connector 11 is inserted to the shroud 13, which is different from the case in which contact springs are provided at the front end of the connector 11, thereby the contact springs 22 are not deformed or damaged as a result of making contact with the end of the shroud 13.

The housing 17 is received inside the shroud 13 when the connector 11 is inserted into the shroud 13. At this time, the housing 17 and the shroud 13 press each other with rather large elastic force exerted by the contact springs 22 so that poor grounding between the housing 17 and the shroud 13 is prevented. Therefore, such a structure with low impedance is very effective as a reliable measure against EMI. Additionally, poor grounding is be avoided even when connection between the connector 11 and the shroud 13 is somewhat unstable, because the housing 17 is pressed from both sides.

Additionally, because grounding is performed through the pins P projecting out of the bottom 13A of the shroud 13, installation of the shroud 13 in the circuit board 12 is achieved at the same time with grounding, so that the number of operations can be decreased as compared with the prior art. This structure is very useful even when shrouds 13 are fabricated at high density in a row, because the springs for contacting 22 are arranged inside the shroud 13 without the projection of any members out of the shroud 13.

Figure 5:
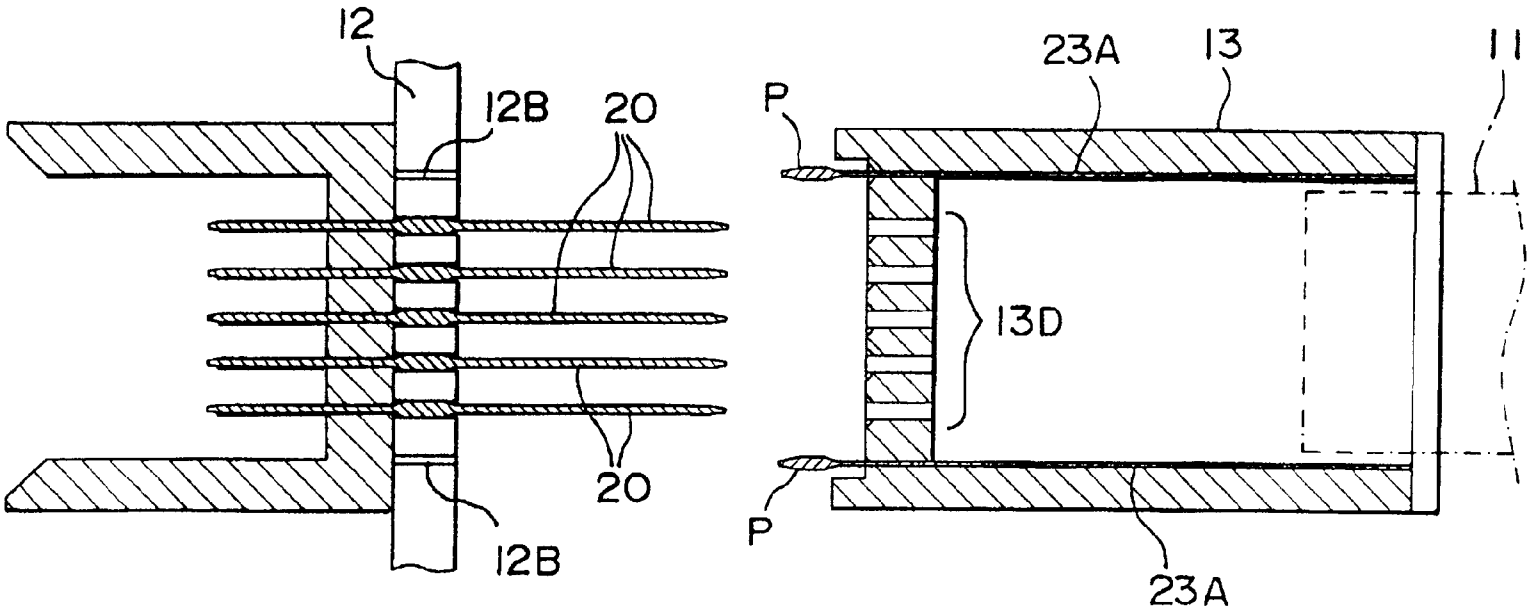
FIG. 5 is an exploded cross section of a second embodiment of the present invention.

Next, a second embodiment is described with reference to FIG. 5. In this embodiment, the male contacts 20 are provided in advance in the circuit board 12, by means of which the shroud 13 with the shielding case 23A is installed on the circuit board 12. Also in this embodiment, the pins P are formed in the shielding case 23A and are inserted into the through hole 12B of the circuit board 12. The reference numeral 13D shows penetrating holes for the male contacts 20. As a result of such a structure, also in this embodiment, as in the first embodiment, a conductive panel and attachments are unnecessary, the contact springs are not damaged nor deformed, and the connector 11 can be reliably connected even when the shroud 13 are arranged at high density on the circuit board 12.

Here, as shown in the drawing, the side walls 13B of the shroud 13 do not interfere with the standing position of the male contacts 20. However, in the case in which the side walls 13B of the shroud can not be arranged between the male contacts for neighboring shrouds, due to the male contacts 20 being provided at a higher density on the circuit boards 12, receiving holes (not shown) may be formed from the bottom wall 13A in the side walls 13B of the shroud and the male contacts 20 for the neighboring shrouds are received in these holes. In this case, needless to say, the male contacts 20 for the neighboring shrouds, received in the holes, are not concerned with transmission of signals.

Figure 6:
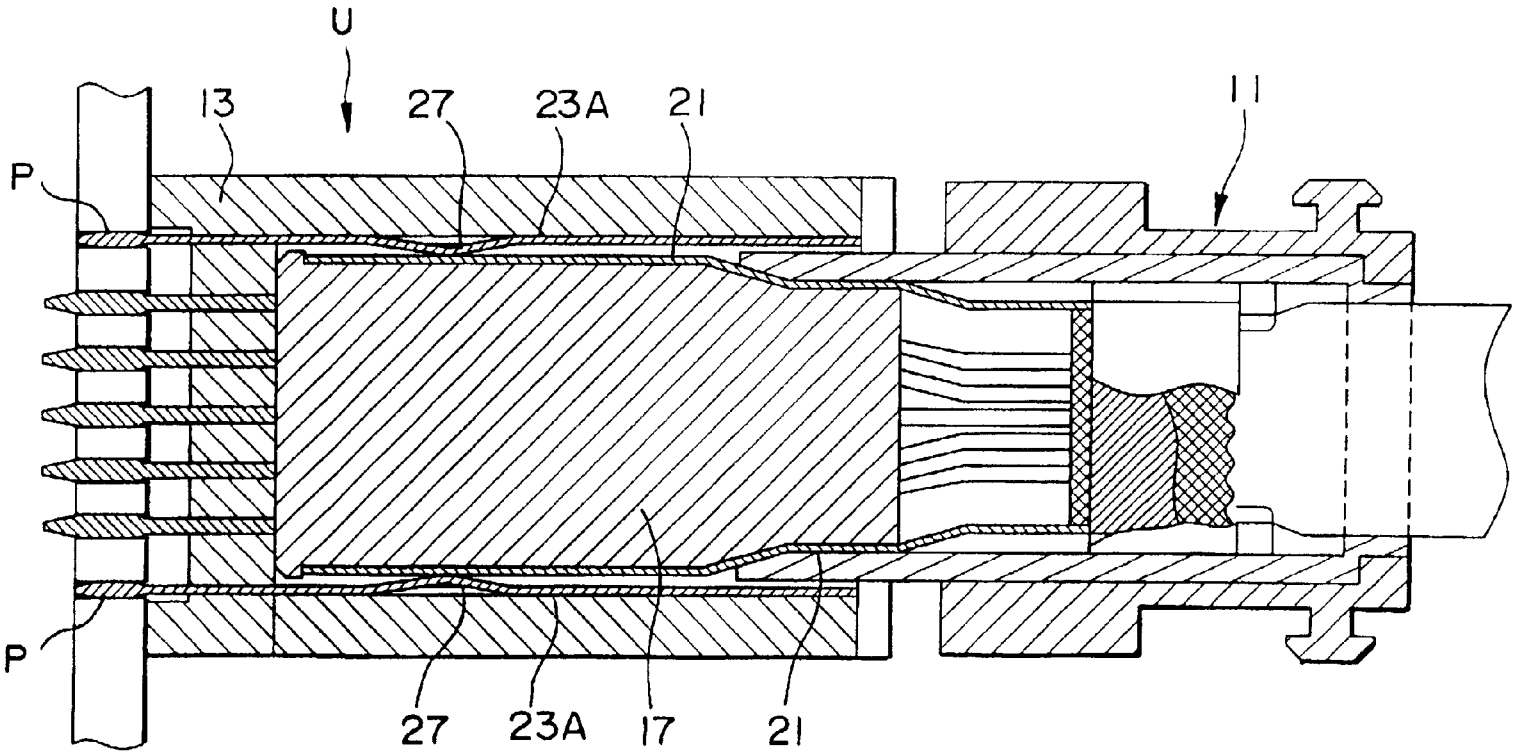
FIG. 6 is a cross view showing a third embodiment of the present invention.

In the following, a third embodiment is described with reference to FIG. 6. Basic structures in this embodiment are the same as those in the first embodiment on the points that, for example, the shield shell 21 is provided in the housing 17 of the connector 11 and the shielding case 23A is provided in the shroud 13. In this embodiment, contact springs (elastic contact members) 27 are formed in the shielding case 23A, for example, by cut-and-raised processing, instead of the contact springs being provided in the shielding shell 21.

Since the contact springs 27 are provided in the shroud 13 in this embodiment, there is another advantage in addition to the advantages of the first embodiment, that is, the possibility of damage of the contact springs 27 on the insertion of the connector 11 is decreased more than when the contact springs are provided in the connector 11 as in the first embodiment. This embodiment can be applied to the structure of second embodiment shown in FIG. 5.

Figure 7:
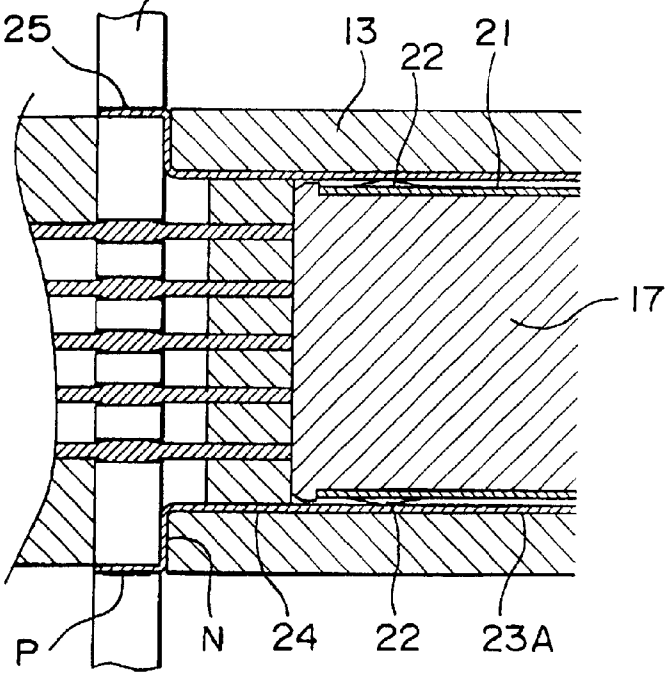
FIG. 7 is a cross view showing a fourth embodiment of the present invention.

In the following, a fourth embodiment is described with reference to FIG. 7. In this embodiment, in addition to the structures of the first embodiment, a part of the shielding case 23A positioned between an engaging part 24 of the shielding case 23A and the pins P is extended, and this extended part (grounding part, extensions) N is put between the shroud 13 and the circuit board 12. This embodiment can be applied to the second and third embodiments. The extended part can be attached, for example, by means of soldering or pressing in. A structure in which the engaging part 24 is directly inserted into the circuit board 12 without pins P can also be adopted.

Figure 8:
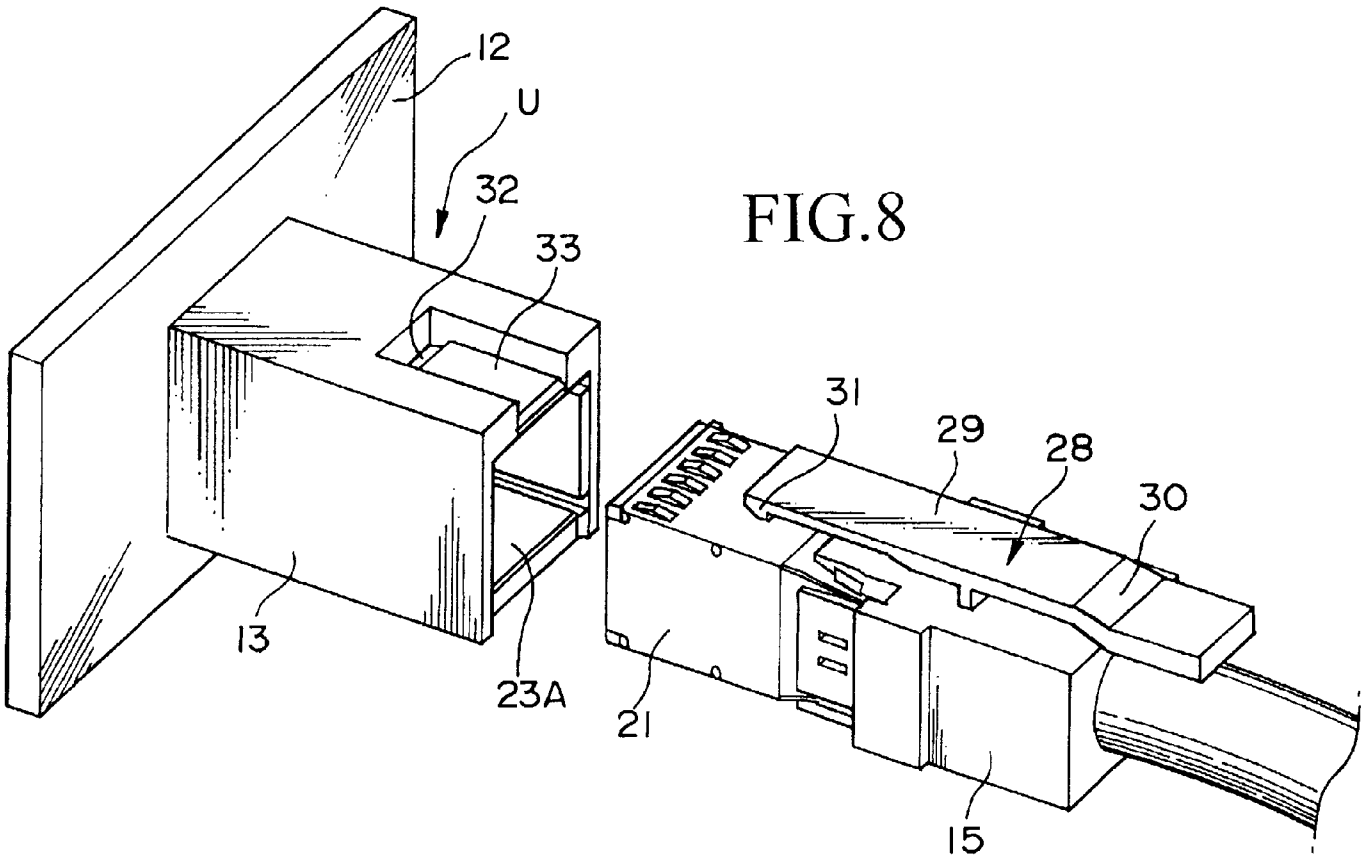
FIG. 8 is a perspective diagram showing a fifth embodiment of the present invention, and corresponds to FIG. 1.
Figure 9:
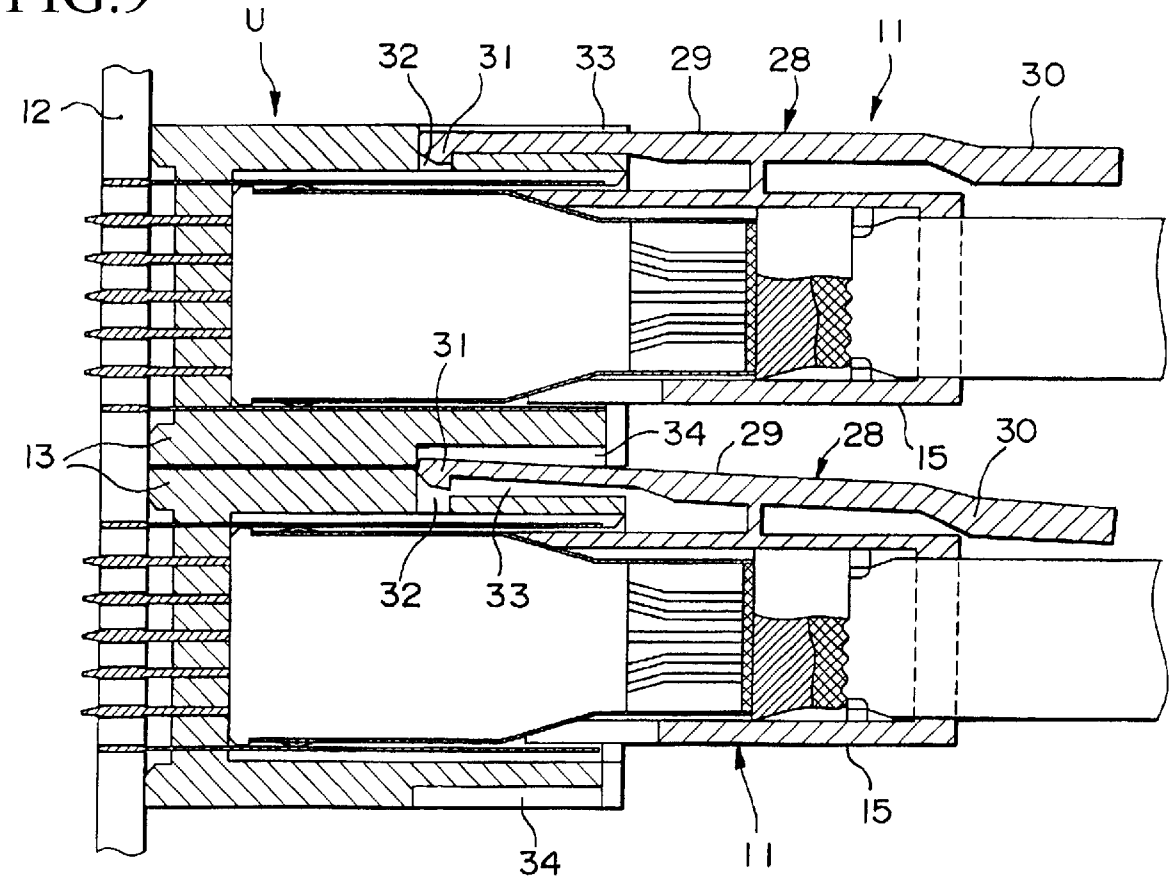
FIG. 9 is a cross view showing the fifth embodiment of the present invention.

According to this embodiment, in the case that the extended part N is fixed by means of soldering, grounding is achieved more reliably, because, in addition to grounding by the through hole 12B for the pins P, the contact area with the grounding layer in the circuit board 12 increases. In the case of pressing in, because the pins P are pushed through the extended part N positioned next to the pins P, the process of pushing of the pins P into the circuit board 12 can be performed smoothly In the following, a fifth embodiment is described with reference to FIGS. 8 and 9. In this embodiment, the connector 11 and the shroud 13 in the first embodiment become engaged and they are locked to each other by means of a locking member 28. There are two shrouds 13 arranged in the case shown in FIG. 9. The locking member 28 comprises an arm 29, the center of which is supported in the cover 15 of the connector 11. A pressed part 30 is provided in the edge near the cable of the arm 29, and an engaging part 31 is provided in the other edge of the arm 29.

A indentation 32 for engagement with the engaging part 31 is formed in the receiving part 33 of the shroud 13. The arrangement of the engaging part 31 and the indentation 32 can be reversed. The engaging part 31 does not project beyond the outer wall of the shroud 13 when the engaging part 31 engages the indentation 32 in the receiving part 33. A hollow 34 for release is formed at a position opposite the receiving part 33 in the neighboring shroud 13 to ensure a space for opening and closing of the engaging part 31. In the figure, the same reference numerals have been given for parts which are analogous to those shown in the first embodiment, and their description shall be omitted.

According to the embodiment described above, the connector 11 can be surely locked to the shroud 13 if the engaging part 31 engages the indentation 32 by means of the elastic force produced by the arm 29 when the connector 11 is inserted into the shroud 13. The locking member 28 does not interfere with the neighboring shroud 13 because the engaging part 31 does not project beyond the outer wall of the shroud 13 when in a locked condition. The opening and closing of the engaging part 31 is not effected by the neighboring shroud 13 because the hollow 34 for release is provided at a position opposite the receiving part 33 in the neighboring shroud 13 to ensure a space for opening and closing of the engaging part 31. In the figure, the contact springs 22 are provided in the shielding shell 21, but an alternative arrangement, in which contact springs 27 can be provided in the shielding shell 23A, can be adopted.

Also in this embodiment, a conductive panel and attachment are unnecessary, contact springs are not damaged, and the connector 11 can be reliably connected even when the shrouds 13 are arranged at high density in rows and columns. In this case too, the locking member 28 does not interfere with the neighboring shroud 13. Additionally, the locking member 28 does not obstruct grounding by the pins P.

Figures 10A, 10B:
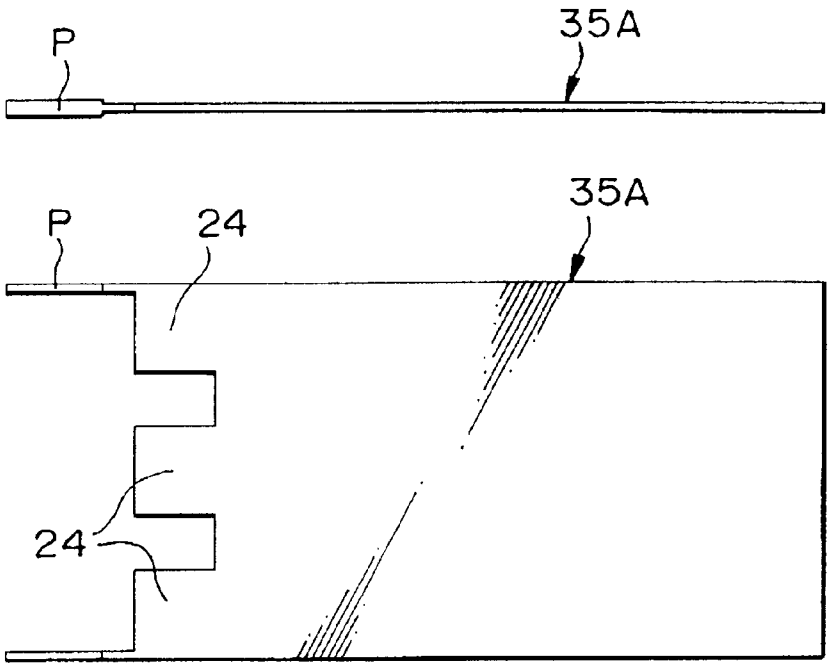
FIGS. 10A and 10B are a front view and a plane view showing a sixth embodiment of the present invention, respectively.
Figure 11:
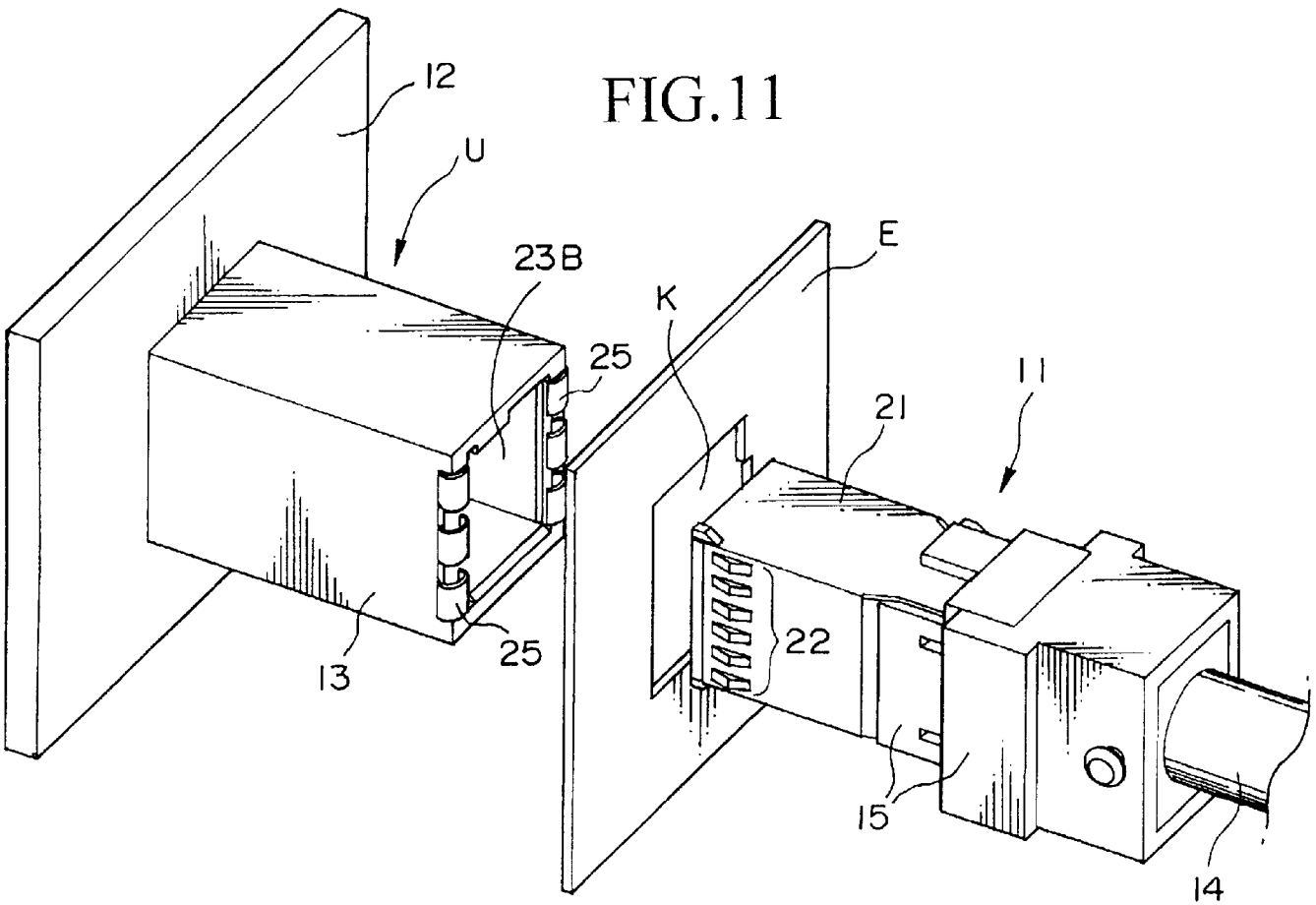
FIG. 11 is a perspective diagram showing a seventh embodiment of the present invention.
Figure 12A:
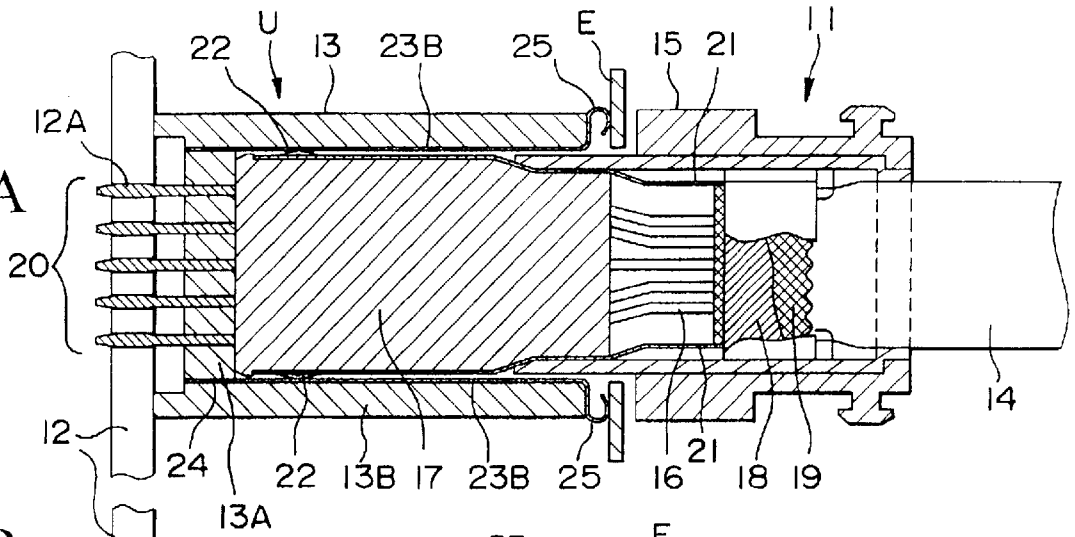
FIGS. 12A and 12B show the seventh embodiment of the present invention in an attached state and FIG. 12A is a cross section along the line A—A in FIG. 12B.
Figure 12B:
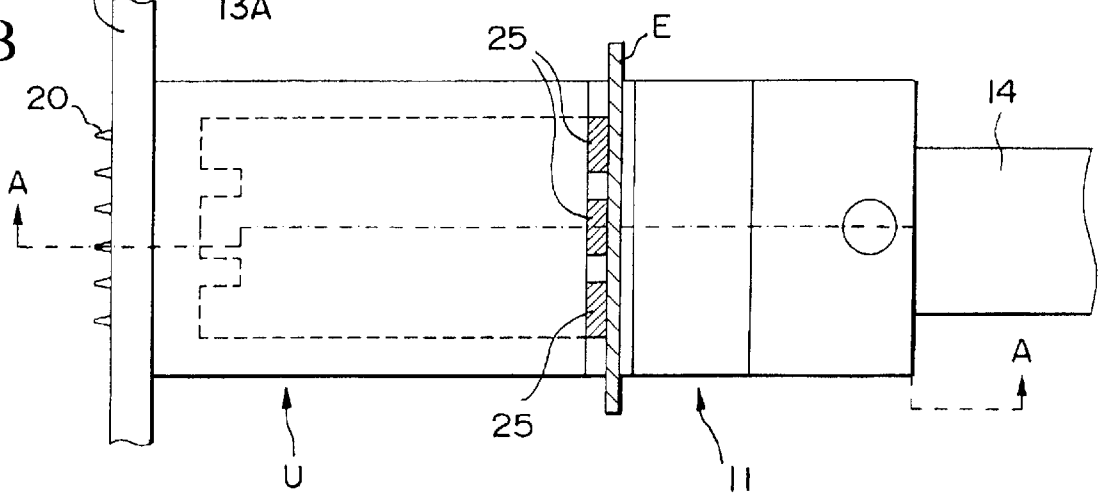

A shielding plate 35A which is a main part of a sixth embodiment is shown in FIG. 10. The shielding case 23A is provided in the shroud 13, but a pair of plate-like shielding plates (shielding members) 35A can be provided instead of the shielding case 23A. Three engaging parts 24 are formed in the shielding plate 35A, and a pair of pins P which are inserted into through holes (not shown) in a circuit board are provided in the engaging parts 24. It is possible to provide only one shielding plate 35A.

In this embodiment, in addition to the advantages of the embodiment described above, cost reductions can be achieved by using the shielding plate 35A in comparison with use of the shielding case. Instead of shielding by a case-shaped shielding such as the shielding case 23A, if the wires 16 (connecting part) of the cable 14 can be covered using both shielding plate 35A and shielding plate 23A, there are no negative effects on the shielding.

The case in which a conductive panel E is used for grounding is described in FIGS. 11 to 15. In the figures, the same reference numerals have been given for parts which are analogous to those shown in the embodiments described above, and their description shall be omitted.

Figure 15:
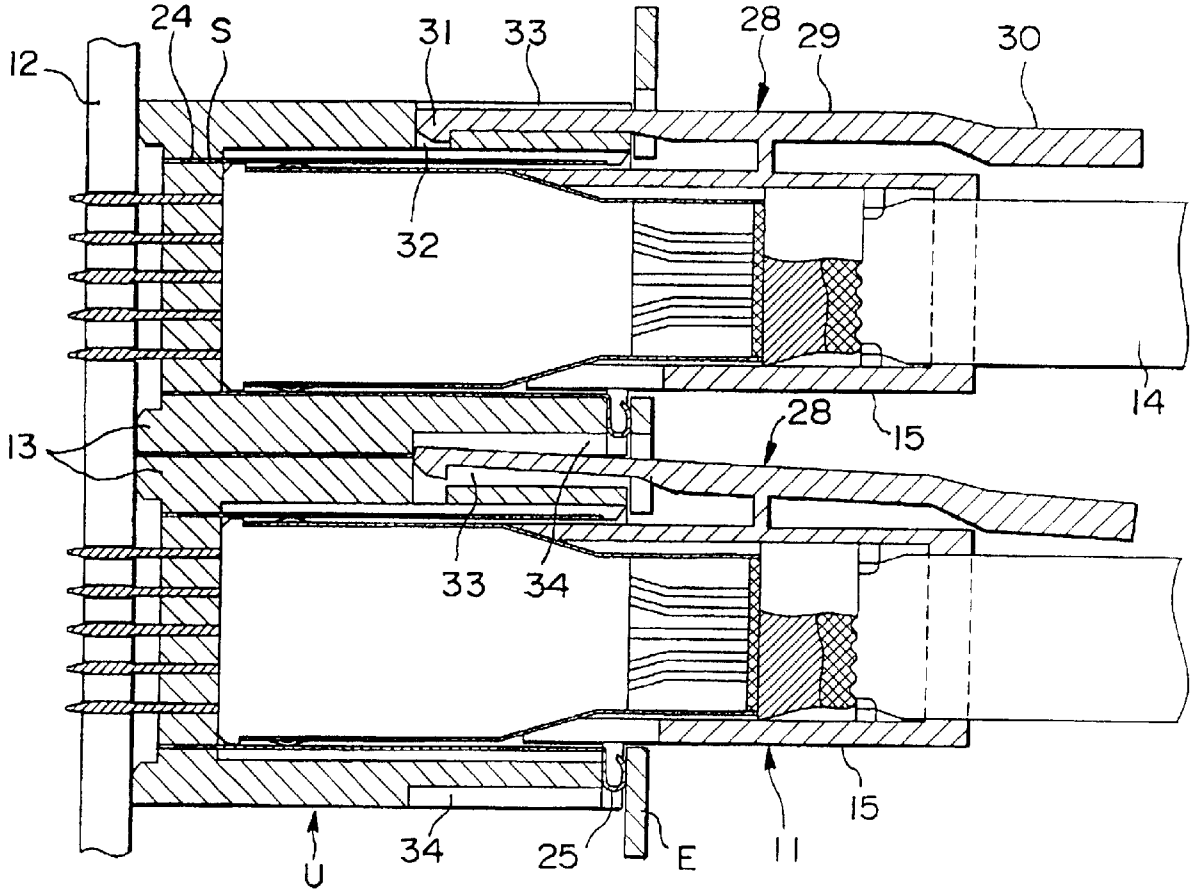
FIG. 15 is a cross section of the eighth embodiment of the present invention.

FIGS. 23 to 15 show a seventh embodiment of this invention. In this embodiment, the connector 11 is inserted through the conductive panel E into the shroud 13 provided in the circuit board 12. Basic structures in this embodiment are the same as those in the first embodiment on the points that, for example, in the connector 11, the cable 14 is supported by the cover 15, and the housing 17 which holds the wires is provided at the front edge of the connector 11.

Figure 13:
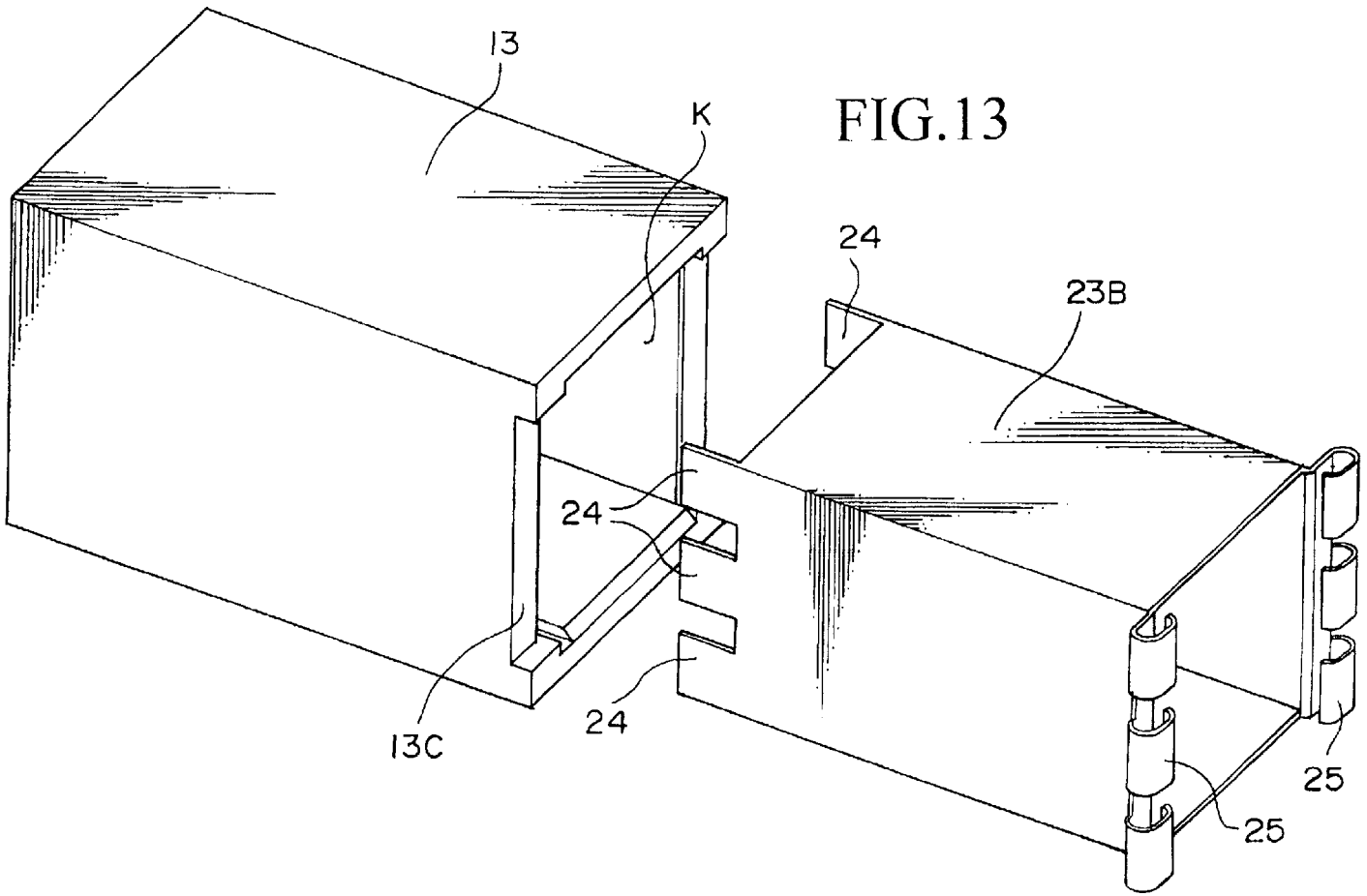
FIG. 13 is a perspective diagram of the main parts of the seventh embodiment of the present invention.

The shroud 13 of the receiving connector U which receives said connector 11 is the same as that in the first embodiment, the A shielding case 23B is set in the shroud 13. The shielding case 23B is pipeshaped with a rectangular cross section as shown in FIG. 13, which is removably inserted into the shroud 13 to cover the inner wall of the shroud 13. Three engaging parts 24, which are inserted into slits S formed in the bottom wall 13A of the shroud 13, are formed at three locations extending from each of a pair of one wall and an opposing wall of the shielding case 23B, near the circuit board. On the other hand, three grounding springs 25, which are put between the opening and the conductive panel E and make elastic contact with a peripheral part of an opening K of the conductive panel E, are provided at each of three locations on each of said one wall and said opposing wall of the shielding case 23B, near the connector 11.

Figures 17A, 17B, 17C:
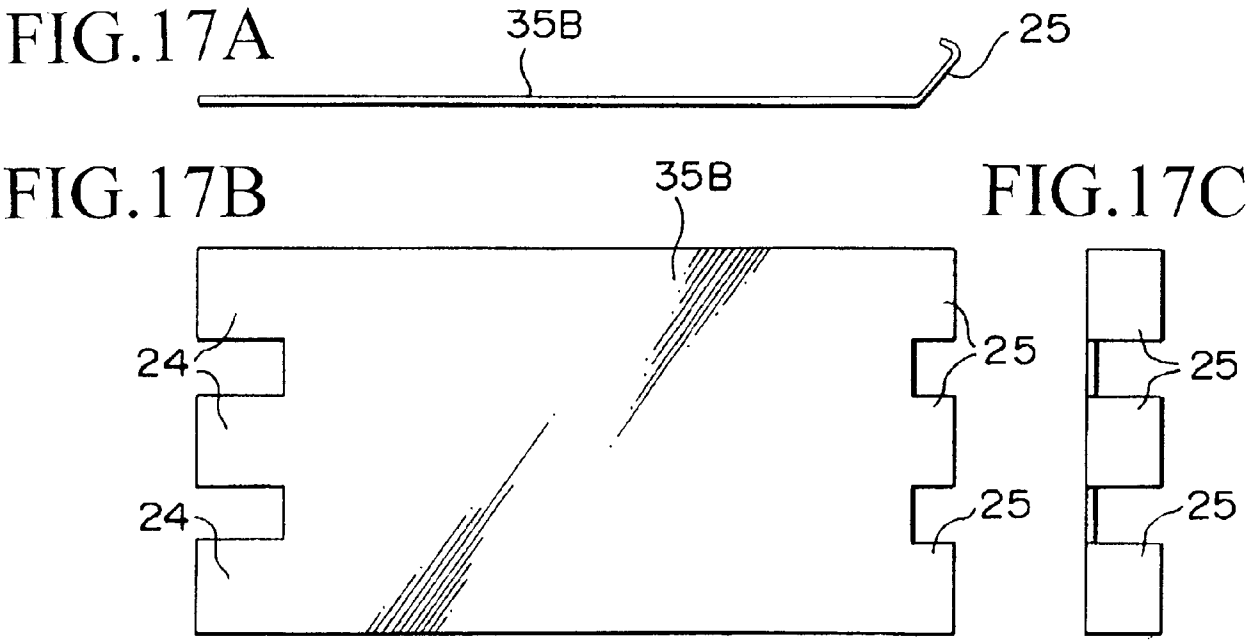
FIGS. 17A to 17C are a front view, a plane view and a side view, showing another aspect of the eighth embodiment of the present invention, respectively.

Cut-out parts 13C, (FIG. 15) which are provided with the grounding springs 25, are formed in the opening of the shroud 13. The cut-out parts 13C make a space between the opening of the shroud 13 and the conductive panel E to be small while keeping elastic force due to the grounding springs 25 sufficient. The grounding springs 25 extend outside along a direction parallel to the opening of the shielding case 23B and then bend inside with a U-shape, as shown in FIG. 13. However, the grounding springs 25 are not limited to the shape described above, and, for example, can be shaped as shown in FIG. 17. The grounding springs 25 may be provided in only one side of the shroud 13. The size of the grounding springs 25 is almost the same as the wall thickness of the shroud 13 so that the grounding springs 25 do not interfere with the neighboring shrouds 13.

The conductive panel E comprising the opening K, through which the connector 11 penetrates, is provided between the connector 1 land the shroud 13 The conductive panel E is supported by a unit including the circuit board 12 and makes electrical connection between the shielding shell 21 in the connector 11 and the shielding case 23B in the shroud 13.

According to the embodiment described above, because the shielding shell 21 in the connector 11 and the shielding case 23B in the shroud 13 are electrically connected to each other in the shroud 13 by means of the contact springs 22 when the connector 11 is inserted into the shroud 13 through the opening K of the conductive panel E, the shielding layer 19 of the cable 14 is electrically connected with high reliability to the conductive panel E which makes elastic contact with the grounding springs 25 provided in the shielding case 23B.

If the connector 11 is inserted into the opening K of the conductive panel E when the connector 11 is inserted, the connector 11 can be surely inserted into the given position of the shroud 13. The grounding springs 25 are not damaged or deformed when the connector 11 is inserted into the shroud 13 because the grounding springs 25 are positioned behind the rear side of the conductive panel E and this is different from the prior art in which the grounding springs 25 are damaged and deformed because they are provided at the front end of the connector 11.

Electromagnetic waves going to the wires 16 from outside or electromagnetic waves coming out of the wires 16 can be reliably shielded by the shielding shell 21 and the shielding case 23A, when the connector 11 is inserted into the shroud 13.

The housing 17 is received inside the shroud 13 when the connector 11 is inserted into the shroud 13. At this time, the housing 17 and the shroud 13 press each other with rather large elastic force due to the contact springs 22 so that poor electric connection between the housing 17 and the shroud 13 is prevented. Therefore, such a structure with low impedance is very effective as a reliable measure against EMI. Additionally, poor electric connection at the connecting area is avoided even when connection between the connector 11 and the shroud 13 is somewhat unstable, because the housing 17 is pressed from both sides. The conductive panel E which is fixed in the circuit board 12 or the shroud 13 is able to secure elastic contact with the circuit board 12 or the shroud 13 through the grounding springs 25 so that poor contact at the contact point does not occur.

Because the contact springs 22 are positioned within the shroud 13 and the grounding springs 25 do not project out of the outer wall of the shroud 13, the shrouds 13 do not interfere each other even when the shrouds 13 are packaged at high density in a row. The structure shown in FIG. 5 can be applied to this seventh embodiment, and the structure shown in FIG. 6, that is, the structure in which the springs 27 are provided in the shielding case 23A, can be applied to this seventh embodiment.

Figure 14:
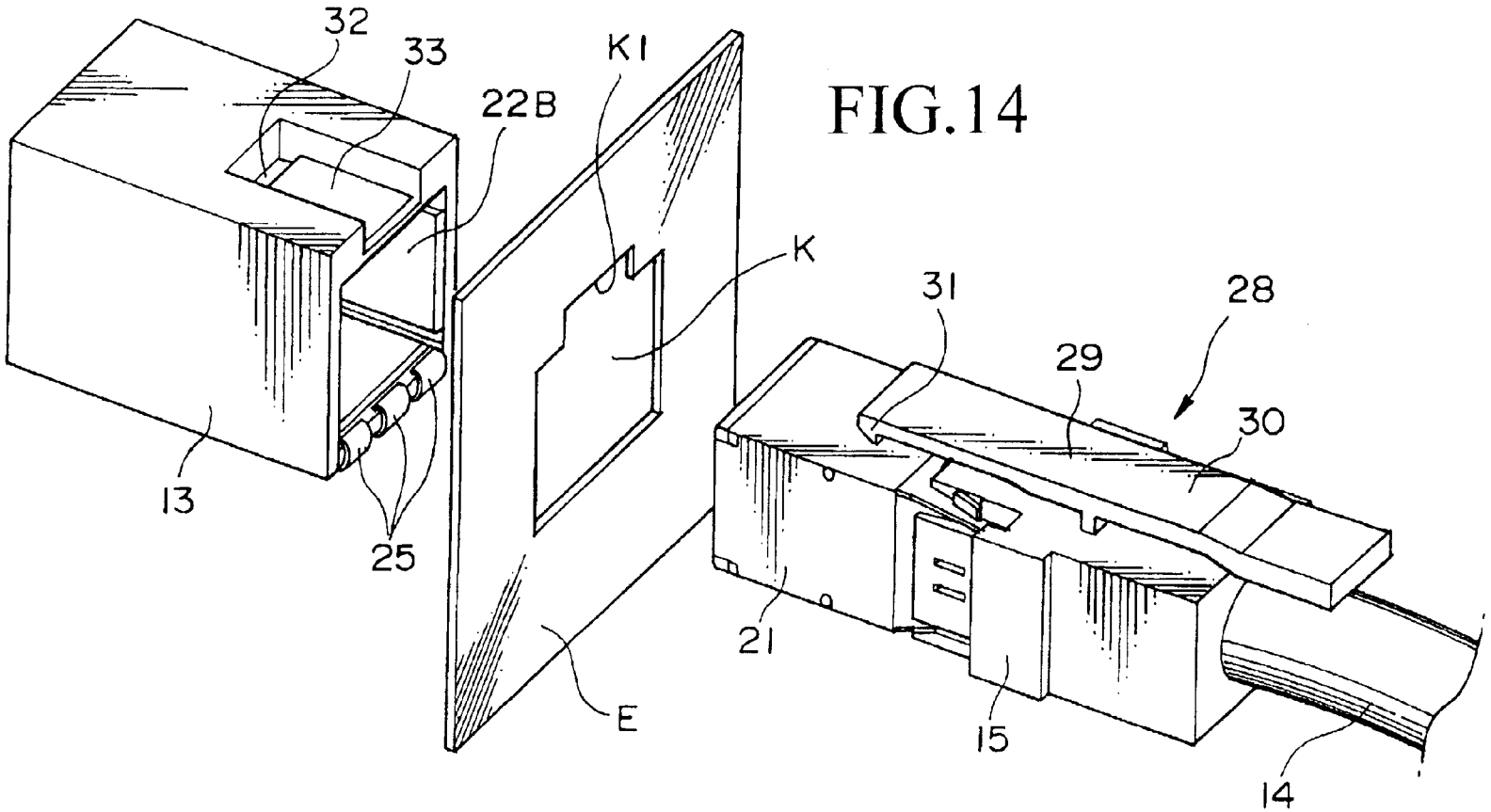
FIG. 14 is a perspective diagram showing an eighth embodiment of the present invention, and corresponds to FIG. 1.

In the following, the eighth embodiment is described using FIGS. 14 and 15. In this embodiment, the connector 11 and the shroud 13 in the embodiment become engaged and they are locked to each other by means of a locking member 28. In the FIG. 15, two shrouds 13 are arranged. The locking member 28 comprises an arm 29, the center of which is supported in the cover 15 of the connector 11. A pressed part 30 is provided at the end near the connector 11 of the arm 29, and an engaging part 11 is provided at the end near the shroud 13 of the arm 29.

On the other hand, an indentation 32 for engagement with the engaging part 11 is formed in the receiving part 33 of the shroud 13. The arrangement of the engaging part 31 and the indentation 32 can be reversed. The engaging part 31 does not project beyond the outer wall of the shroud 13 when the engaging part 31 engages the indentation 32 in the receiving part 33. A hollow 34 for release is formed at a position opposite the receiving part 33 in the neighboring shroud 13 to ensure a space for opening and closing of the engaging part 31. A cut-off area K1 for release of the locking member 28 is formed in an opening K of the conductive panel E. In the shielding case 23B installed within the shroud 13, there are no grounding springs 25 in the side to which the locking member 28 is provided.

In the drawing, the same reference numerals have been given for parts which are analogous to those shown in the first embodiment, and their description shall be omitted.

According to the embodiment described above, the connector 11 can be securely locked to the shroud 13 if the engaging part 31 engages the indentation 32 by means of the elastic force produced by the arm 29 when the connector 11 is inserted into the shroud 13 from the opening K of the conductive panel E. The locking member 28 does not interfere with the neighboring shroud 13 because the engaging part 31 does not project beyond the outer wall of the shroud 13 when in the locked condition. The opening and closing of the engaging part 31 is not effected by the neighboring shroud 13 because the hollow 34 for release is provided at a position opposite the receiving part 33 in the neighboring shroud 13 to ensure space for opening and closing of the engaging part 31. In the figure, the contact springs 22 are provided in the shielding shell 21, but an alternative arrangement, in which contact springs 27 can be provided in the shielding shell 23B, can be adopted.

Grounding can be surely achieved by means of the grounding springs 25 arranged in the rear side of the conductive panel E. In this figure, the grounding springs 25 are provided at only one side, but poor grounding resulting from the insertion does not come about because the conductive panel E is securely fixed to the shroud 13 or to the circuit board 12 and the fixation is not effected by the insertion of the connector 11. The contact springs 22 and the grounding springs 25 are not damaged or deformed when the connector 11 is inserted. The connector 11 can be reliably connected even when shrouds 13 are mounted at high density in rows and columns on the circuit board 12. At this time, the locking member 28 does not interfere with the neighboring shrouds.

Figure 16A:
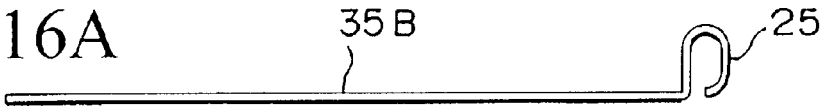
FIGS. 16A to 16C are a front view, a plane view and a side view, showing a ninth embodiment of the present invention, respectively.
Figure 16B:
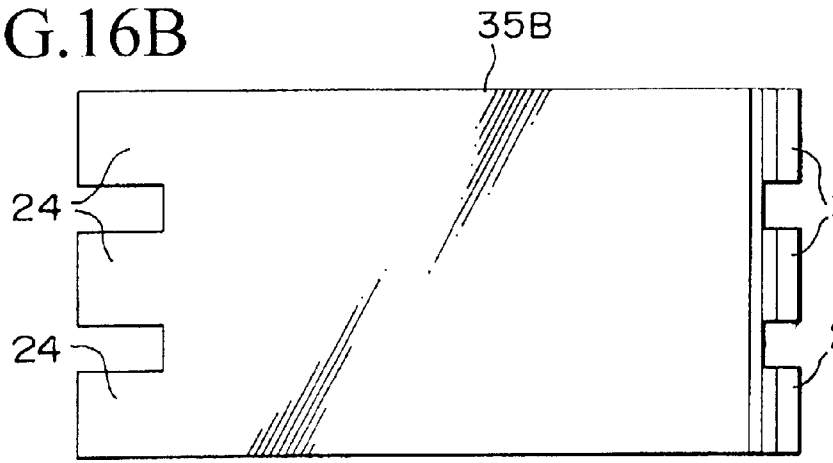
Figure 16C:
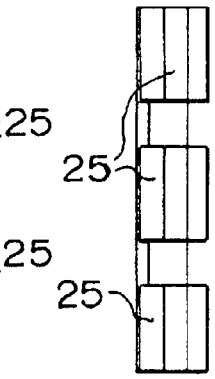

FIG. 16 shows the shielding plate 35A which is the main part of a ninth embodiment. A pair of plate-type shielding plates (shielding member) 35B are provided, instead of the shielding cases 23B provided in the shroud 13 in the preceding embodiments. Three engaging parts 24 are formed in one side of the shielding plates 35B, and grounding springs 25, the same as those in the embodiments described above, are provided in the other side.

The grounding springs 25 may be shaped to be raised obliquely from the edge of shielding plates 35B and parts of the grounding springs 25 may be shaped to be arched. It is possible to provide only one shielding plate 35B. In this case, the side must be the same side as that provided with the contact springs in the shielding shell.

In this embodiment, in addition to the advantages of the embodiments described above, the structure is simpler and cost reductions can be achieved by using the shielding plate 35B compared with the use of the shielding case. Instead of shielding by a case-shaped shielding such as the shielding case 23B, if the wires 16 (connecting part) of the cable 14 can be covered using both shielding plate 35B and shielding plate 23B, there arc no negative effects on the shielding.

Figure 18:
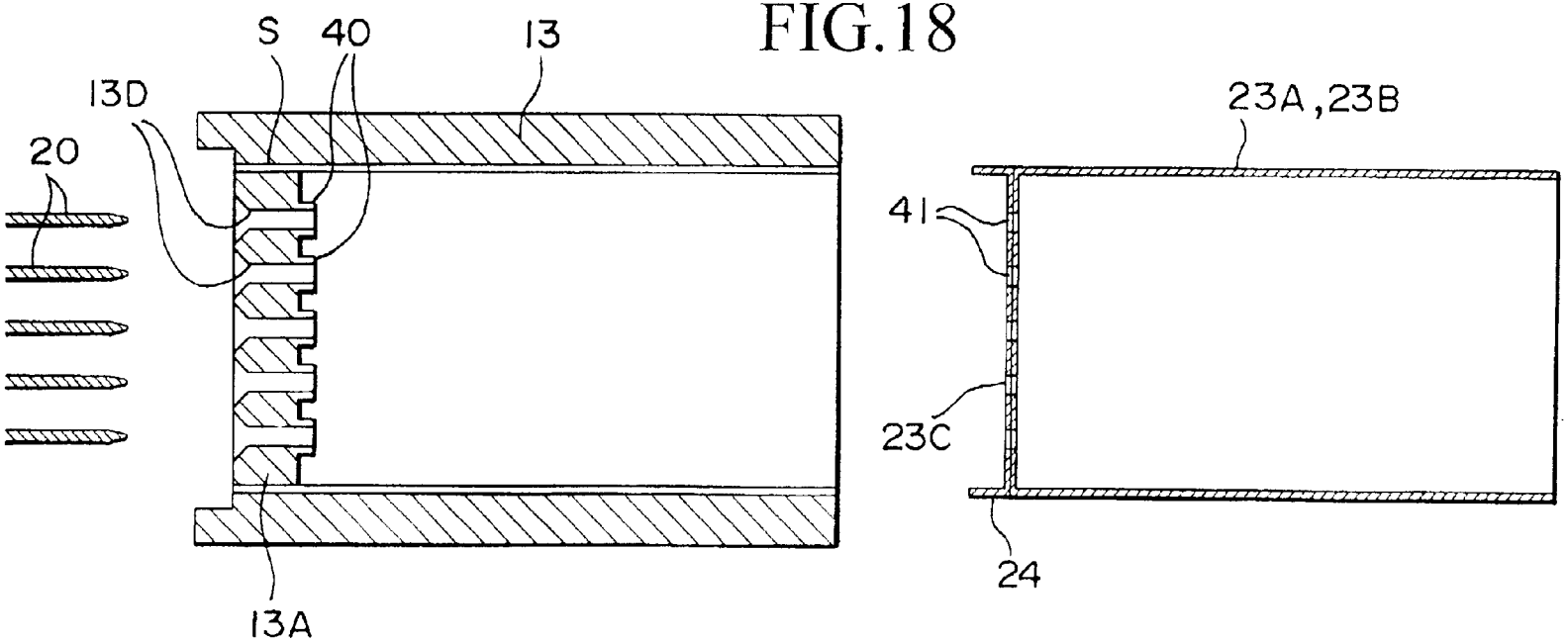
FIG. 18 is an exploded cross section of another embodiment of the present invention.
Figure 19:
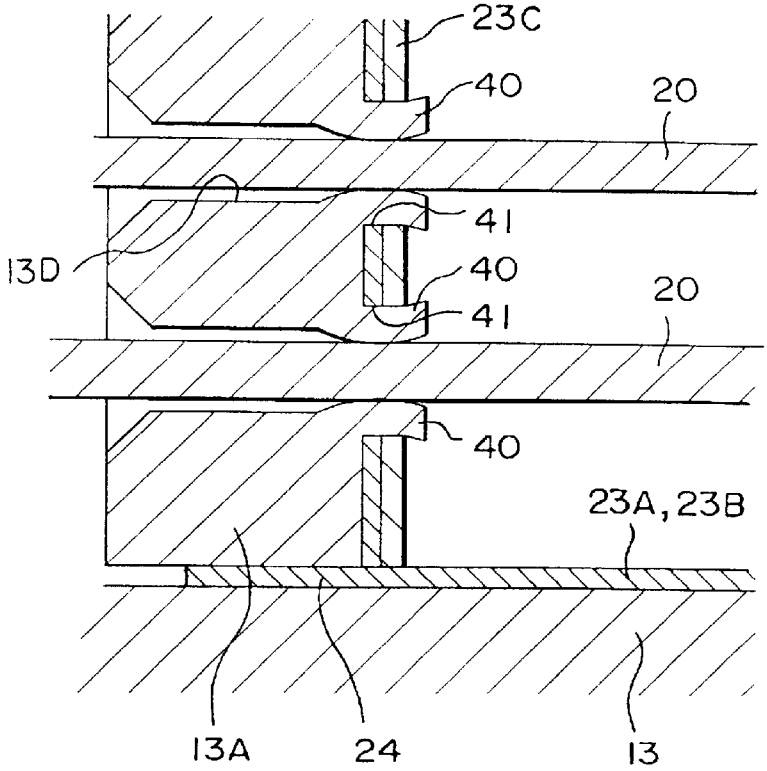
FIG. 19 is an enlarged cross section of the embodiment shown in FIG. 18 in a fixed state.
Figure 20:
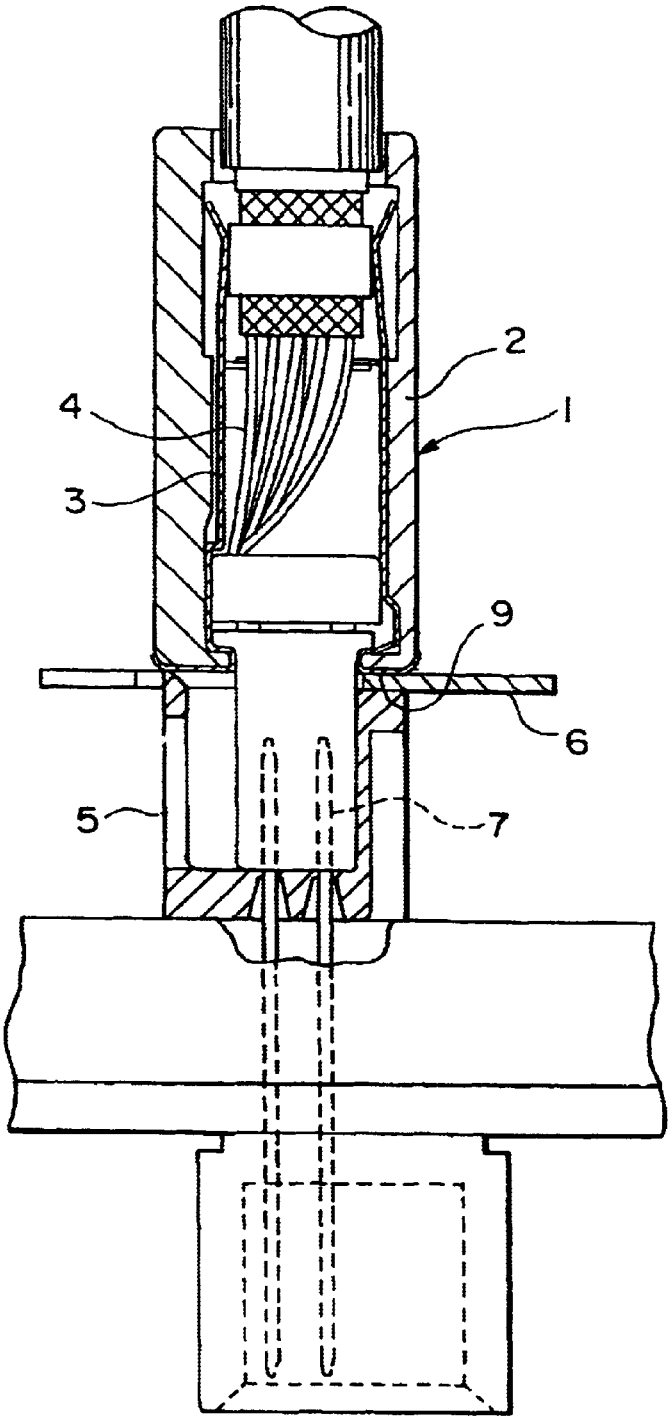
PRIOR ART FIG.20
FIG. 20 is a cross section of the conventional art in an installed state.
Figure 21:
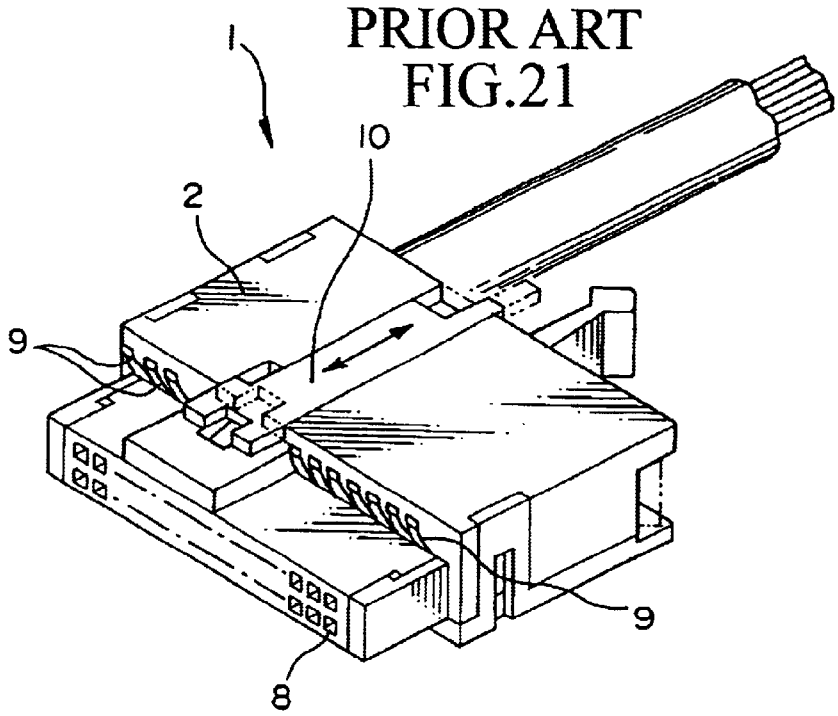
PRIOR ART FIG.21
FIG. 21 is a perspective diagram showing the conventional art.

Another embodiment for assembling the shroud 13 in the embodiment described above is shown in FIGS. 18 and 19. In this embodiment, through holes 13D, which are formed in the bottom of the shroud 13, are sized to be penetrated loosely by MALE connectors to which are provided on the circuit board 12. The side from which the male contacts 20 are inserted into the through holes 13D is formed to be wider than the other side. Built-up parts 40 are formed on the other side of the through holes 13D. The inner size of the opening of each built-up part 40 become smaller than that in the rest of the through holes 13D because the opening of the built-up part 40 is deformed when the shielding case 23B is installed as shown in FIG. 19.

On the other hand, a bottom wall 23C is formed in the shielding case 23A or 23B installed in the shroud 13. Holes 41, into which the built-up parts 40 are inserted, are formed in the bottom wall 23C. For example, when the male contacts 20 are inserted through holes 13D with the built-up parts 40 set into the holes 41, the size of the opening in each built-up part 40 become larger and thereby the shielding case 23A or 23B, the shroud 13 and the male contacts 20 are integrally fixed. The bottom walls 23C are made of double-bent metal and are thereby formed thickly. The reference numeral 14 shows engaging parts.

By applying the structure described above to the preceding embodiments, the number of installation operations can be decreased, because the shielding case 23A or 23B, the shroud 13 and the male contacts 20 can be integrally fixed. In the description above, a case in which the shielding case 23A or 23B is used is described, but if the bottom walls are formed in the shielding plates 35A or 35B in the embodiment above, the structure described above can be applied.

The shrouds 13 in the embodiment above can be used both in cases with and without the conductive panels E, the shielding case 23A or 23B can be installed selectively within the shroud 13. In the case with the conductive panels E, the shielding case 23B grounded to the conductive panels E is installed within the shroud 13 which is fixed to the circuit board 12. On the other hand, in the case without the conductive panels E, the shielding case 23A grounded to the circuit board 12 is installed within the shroud 13 which is fixed to the circuit board 12. Thereby, the same shroud can be used both in cases with and without the conductive panels E by only exchanging the shielding member. The shielding cases can be installed by a simple operation in which the engaging parts 24 are inserted into the slits S in the bottom wall 1 3A in the shroud 13.

The present invention is not limited to the embodiments described above. For example, although a structure in which the whole surface of the shielding shell 21 is exposed has been described with reference to FIG. 2, a structure in which only the parts for the contact springs 22 in the surface of the shielding shell 21 are exposed on the shielding shell 21 and the other parts are covered with insulating materials, can be used.

As described above, the invention has an advantageous effect by which contact springs can be arranged in areas in which a conductive panel and attachments are not arranged because the shielding member in the shielded connector can make reliable electrical connection with the shielding member in the receiving connector within the shroud, and the shielding layer surrounding the cable can be reliably grounded to the circuit board through the grounding parts in the shielding member in the receiving connector. The invention has an advantageous effect by which the contact springs are not damaged when the shielded connector is connected to receiving connector because the contact springs can be arranged at position other than the front end of the shielded connector. This invention has an advantageous effect by which the connection between a shielded connector and a receiving connector can be surely achieved even when receiving connectors are mounted at high density because the shielded connectors and the receiving connectors are connected to each other by inserting the shielded connectors into the receiving connectors. The invention has an other advantageous effect by which, when the shielded connector is inserted into the shroud in the receiving connector, the shielding member in the connector can make reliable electrical connection with the shielding member in the receiving connector by means of contact springs and the shielding layer surrounding the cable can be reliably grounded to the conductive panel due to the elastic contact between the grounding springs of the shielding layer in the receiving connector and the conductive panels, and thereby such a structure is very effective for a reliable measure against EMI. This invention has an advantageous effect such that the grounding springs are not deformed or damaged when the connector is inserted because the grounding springs make elastic contact with the rear side of the conductive panel and does not project outward.

The invention further has an advantageous effect by which contact springs can be arranged in areas in which a conductive panel and attachments are not arranged because both shielding members can make reliable electrical connection with each other by means of contact springs provided in the shielded connector and the shielding layer surrounding the cable can be reliably grounded to the circuit board through the grounding parts formed in the shielding member in the receiving connector. This invention has an advantageous effect by which the contact springs are not damaged when the shielded connector is connected to the receiving connector because the contact springs can be arranged not at the front end of the shielded connector.

The invention has an advantageous effect by which contact springs can be arranged in areas in which a conductive panel and attachments are not arranged because both shielding members can make reliable electrical connection with each other by means of contact springs provided in the shielded connector and the shielding layer surrounding the cable can be reliably grounded to the circuit board through the grounding parts formed in the shielding member in the receiving connector. This invention has an advantageous effect by which the contact springs are not damaged when the shielded connector is inserted into the receiving connector because the contact springs are not provided in the shielded connector.

The invention described has an advantageous effect by which the number of operations for installation can be reduced because the extensions can be grounded to the circuit board whenever the shroud is installed in the circuit board.

The invention described in claim 6 has an advantageous effect by which cost reductions can be achieved by the simplification in the structure of the shielding member, in addition to the advantageous effect described above.

The invention described has an advantageous effect by which cost reductions can be achieved because grounding can be achieved by means of the minimum number of grounding spring in addition to the advantageous effect described above. This invention has an advantageous effect by which, even though the grounding springs 25 are provided at only one side, grounding through the shielding member in the shroud is not affected from such a structure and poor grounding resulting from the insertion does not come about because the conductive panel is fixed in advance before the shielded connector is inserted.

The invention described has advantageous effect by which removal of the shielded connector from the receiving connector when the shielded connector is inserted to the receiving connector is prevented because the shielded connector and the receiving connector can be reliably connected.

The invention described has an advantageous effect by which the grounding can be grounded more reliable because the shielding member in the shroud can be grounded both to the conductive panel and the circuit board.

The invention described has an advantageous effect by which the shielded connector can be reliably grounded whenever the shielded connector is inserted into the receiving connector because the shielding layer surrounding the cable can make reliable electrical contact with the circuit board or the conductive panel through the shielded connector and the receiving connector.

What is claimed is:

1. A cable connector removably attachable to a circuit board for electrically interconnecting the circuit board and a multi-conductor shielded cable, the cable connector comprising:

a cable receptacle having a housing in which cable conductors can be terminated;

an elongated housing shield surrounding the housing and electrically connectable to a shielding layer of a multi-conductor shielded cable;

a shroud having an elongated recess sized to removably receive the cable receptacle so that the elongated housing shield is disposed substantially entirely within the elongated recess and is spaced inward therefrom when the cable receptacle is attached to the shroud;

an elongated shroud shield extending substantially along the entire length of the elongated recess and juxtaposed with the elongated housing shield within the elongated recess, so that the elongated shroud and housing shields provide a double shield cover protecting the cable conductors from electromagnetic interference along substantially the entire length of the elongated recess when the cable receptacle is attached to the shroud;

a grounding member extending from the elongated shroud shield toward the circuit board for grounding the circuit board when the cable connector is attached to the circuit board; and an elastic member mounted between and pressing against the elongated housing and shroud shields for providing electrical contact therebetween upon attachment of the cable receptacle to the shroud, wherein the cable receptacle has an elongated latch spaced outwardly from and juxtaposed with the elongated housing shield and operative to swing about an axis which extends transversely to the housing, and wherein the shroud has an outer surface provided with a recess which is engaged by the latch upon attachment of the cable receptacle to the shroud.

2. The cable connector defined in claim 1, wherein the elongated shroud shield is case shaped and has an outer surface extending complementary to and juxtaposed with substantially the entire surface of the elongated recess.

3. The cable connector defined in claim 1, wherein the elongated shroud shield has plate shaped side members.

4. The cable connector defined in claim 1, wherein the shroud has a bottom juxtaposed with and facing the circuit board and a mating end spaced from the bottom and facing away from the circuit board, the elastic member being located close to the bottom upon attachment of the cable receptacle to the shroud.

5. The cable connector defined in claim 1, wherein the housing shield is shell-shaped and further comprises a plurality of male connectors extending into the elongated shroud and terminating close to the mating end of the shroud, the housing of the cable receptacle having a plurality of openings aligned to receive the male connectors and receiving them upon attachment of the cable receptacle to the shroud.

6. The cable connector defined in claim 1, wherein the elastic member is provided on the elongated housing shield.

7. The cable connector defined in claim 1, wherein the elastic member is provided on the elongated shroud shield.

8. A cable connector for connecting a multi-conductor shielded cable to a circuit board, comprising:

a housing in which cable conductors can be terminated;

an elongated housing shield surrounding the housing;

a shroud having an elongated recess therein which is effective to removably receive the housing so that the longitudinal housing shield extends substantially the entire length of the elongated recess and is spaced inward therefrom;

a shroud shield received in the elongated recess and surrounding the elongated housing shield along substantially the entire length of the recess when the housing is inserted into the shroud, so that the elongated housing shield and shroud shield form a double shield cover protecting the cable conductors from electromagnetic interference along substantially the entire length of the recess when the housing shield is inserted into the shroud;

a grounding member extending from the shroud shield toward the circuit board for grounding the circuit board upon the attachment of the cable connector to the circuit board and;

an elastic member mounted between and pressing against the elongated housing shield and shroud shield that provides electrical contact therebetween when the elongated housing shield is inserted into the elongated recess of the shroud, wherein the housing has an elongated latch spaced outwardly from and juxtaposed with the elongated housing shield and operative to swing about an axis which extends transversely to the housing, and wherein the shroud has an outer surface provided with a recess which is engaged by the latch upon attachment of the housing to the shroud.

9. A cable connector removably attachable to a circuit board for electrically connecting the circuit board to a multi-conductor cable, the cable connector comprising:

a housing in which cable conductors can be terminated;

an elongated housing shield surrounding the housing;

a shroud having an elongated recess, the housing being removably insertable within the elongated recess so that the elongated housing shield extends along substantially its entire length, and is spaced inwardly therefrom;

a shroud shield plate mounted within and extending along substantially the entire length of the elongated recess, so that the shroud plate and elongated housing shield form a double shield cover protecting the cable conductors from electromagnetic interference substantially along the entire length of the elongated recess upon connecting the cable connector to the circuit board;

a grounding member extending from the shroud plate toward the circuit board for grounding the circuit board upon its attachment to the cable connector; and an elastic member mounted between and pressing against the elongated housing and shroud shields for providing electrical contact therebetween when the cable receptacle is attached to the shroud, wherein the housing has an elongated latch spaced outwardly from and juxtaposed with the elongated housing shield and operative to swing about an axis which extends transversely to the housing, and wherein the shroud has an outer surface provided with a recess which is engaged by the latch upon attachment of the housing to the shroud.

10. A cable connector removably attachable to a circuit board for electrically connecting the circuit board to a cable, the cable connector comprising:

a cable receptacle having a housing for holding a cable and an elongated housing shield which surrounds the housing;

a shroud having an elongated recess which removably receives the elongated housing shield extending within the elongated recess so that the elongated housing shield is spaced inwardly therefrom along an entire length of the elongated recess when the cable receptacle is attached to the shroud;

a shroud shield mounted in and extending substantially along the entire length of the elongated recess so that the shroud shield is juxtaposed with the housing shield and forms a double shield cover protecting the cable conductors from electromagnetic interference along substantially the entire length of the elongated recess when the cable receptacle is attached to the shroud;

a first grounding member provided on one of the opposite ends of the shroud shield and extending toward the circuit board for grounding the circuit board upon the attachment of the cable connector to the circuit board;

an elastic contact member provided between the shroud shield and the housing shield to enable electrical and mechanical contact therebetween when the housing is inserted into the elongated recess;

a resilient second grounding member provided on the other of the opposite ends of the shroud shield and extending beyond the shroud; and a conductive panel located between the shroud and the cable receptacle when the cable receptacle is attached to the shroud and in contact with the resilient member to apply a force against the resiliency of the second grounding member upon attachment of the cable connector to the circuit board, wherein the cable receptacle has an elongated latch spaced outwardly from and juxtaposed with the elongated housing shield and operative to swing about an axis which extends transversely to the housing, and wherein the shroud has an outer surface provided with a recess which is engaged by the latch upon attachment of the housing to the shroud.

11. A cable connector removably attachable to a circuit board for electrically interconnecting the circuit board and a multi-conductor shielded cable, the cable connector comprising:

a cable receptacle having a housing in which cable conductors can be terminated;

an elongated housing shield surrounding the housing and electrically connectable to a shielding layer of a multi-conductor shielded cable;

a shroud having an elongated recess sized to removably receive the cable receptacle so that the elongated housing shield is disposed substantially entirely within the elongated recess and is spaced inward therefrom when the cable receptacle is attached to the shroud;

an elongated shroud shield extending substantially along the entire length of the elongated recess and juxtaposed with the elongated housing shield within the elongated recess, so that the elongated shroud and housing shields provide a double shield cover protecting the cable conductors from electromagnetic interference along substantially the entire length of the elongated recess when the cable receptacle is attached to the shroud;

a conductive panel mounted between the cable receptacle and the shroud;

the elongated shroud shield extending beyond the mating end of the shroud and provided with a resilient grounding element which presses against the conductive panel upon the attachment of the cable receptacle to the shroud; and an elastic member mounted between and pressing against the elongated housing and shroud shields for providing electrical contact therebetween upon attachment of the cable receptacle to the shroud, wherein the cable receptacle has an elongated latch spaced outwardly from and juxtaposed with the elongated housing shield and operative to swing about an axis which extends transversely to the housing, and wherein the shroud has an outer surface provided with a recess which is engaged by the latch upon attachment of the housing to the shroud.

12. The cable connector defined in claim 11, wherein the elongated shroud shield is case shaped and has an outer surface extending complementary to and juxtaposed with substantially the entire surface of the elongated recess.

13. The cable connector defined in claim 11, wherein the elongated shroud shield has plate-shaped side members.

14. The cable connector defined in claim 11, wherein the shroud has a bottom juxtaposed with and facing the circuit board and a mating end spaced from the bottom and facing away from the circuit board, the elastic member being located close to the bottom upon attachment of the cable receptacle to the shroud.

15. The cable connector defined in claim 11, wherein the housing shield is shell-shaped and further comprises a plurality of male connectors extending into the elongated shroud and terminating close to the mating end of the shroud, the housing of the cable receptacle having a plurality of openings aligned to receive the male connectors and receiving them upon attachment of the cable receptacle is to the shroud.

16. The cable connector defined in claim 11, wherein the elastic member is provided on the elongated housing shield.

17. The cable connector defined in claim 11, wherein the elastic member is provided on the elongated shroud shield.

* * * * *